US011522309B2

(12) United States Patent
Yanase et al.

(10) Patent No.: US 11,522,309 B2
(45) Date of Patent: Dec. 6, 2022

(54) CONNECTOR AND METHOD FOR MANUFACTURING THE SAME

(71) Applicant: SMK Corporation, Tokyo (JP)

(72) Inventors: Tomoyasu Yanase, Tokyo (JP); Kiyoshi Asai, Kanagawa (JP); Naoyuki Ono, Chiba (JP); Hiroyasu Kamatani, Tokyo (JP)

(73) Assignee: SMK Corporation, Tokyo (JP)

( * ) Notice: Subject to any disclaimer, the term of this patent is extended or adjusted under 35 U.S.C. 154(b) by 373 days.

(21) Appl. No.: 16/775,280

(22) Filed: Jan. 29, 2020

(65) Prior Publication Data

US 2021/0005993 A1 Jan. 7, 2021

(30) Foreign Application Priority Data

Jul. 4, 2019 (JP) ..... JP2019-125329

(51) Int. Cl.
*H01R 43/24* (2006.01)
*H01R 12/77* (2011.01)
*H01R 13/193* (2006.01)

(52) U.S. Cl.
CPC ..... *H01R 12/775* (2013.01); *H01R 13/193* (2013.01); *H01R 43/24* (2013.01)

(58) Field of Classification Search
CPC ..... H01R 12/716; H01R 12/724; H01R 13/6471; H01R 13/6582; H01R 24/60; H01R 13/6581; H01R 13/6585; H01R 24/50; H01R 12/57
See application file for complete search history.

(56) References Cited

U.S. PATENT DOCUMENTS 10,361,510 B2 7/2019 Tanaka
11,169,340 B2 * 11/2021 Little ..... G02B 6/43
11,289,838 B2 * 3/2022 Ashibu ..... H01R 12/57
(Continued)

FOREIGN PATENT DOCUMENTS

CN 109155492 A 1/2019
CN 109390720 A 2/2019
WO 2017212862 A1 12/2017

OTHER PUBLICATIONS

Notice of First Office Action for Patent Application No. 202010165747.8, issued by The National Intellectual Property Administration of the People's Republic of China dated Feb. 28, 2022.

*Primary Examiner* — Truc T Nguyen

(57) ABSTRACT

There are provided a connector having excellent transmission characteristics, and a method for manufacturing such a connector, by which a connector can be manufactured more easily than in the conventional techniques, and thus its manufacturing cost can be reduced. A conductor base member including central terminal portions to form signal terminals, a grounded conductor portion to form a grounded conductor, connecting portions for connecting between the central terminal portions and the grounded conductor portion so as to integrate them together is integrally formed with an electrically conductive material. Then, the conductor base member is integrally fixed to the housing, and the connecting portions are cut to configure the central terminal portions as the central terminals and configure the grounded conductor portion as the grounded conductor, thereby obtaining a plug.

4 Claims, 27 Drawing Sheets

(56) References Cited

U.S. PATENT DOCUMENTS

| | | | | |
|---|---|---|---|---|
| 2017/0033510 | A1* | 2/2017 | Ozeki | H01R 43/205 |
| 2018/0013240 | A1* | 1/2018 | Takeuchi | H01R 13/652 |
| 2019/0052005 | A1 | 2/2019 | Hasegawa | |
| 2020/0403366 | A1* | 12/2020 | Cai | H01R 43/16 |

* cited by examiner

CONNECTOR AND METHOD FOR MANUFACTURING THE SAME

CROSS REFERENCE TO RELATED APPLICATION

The contents of the following Japanese patent application are incorporated herein by reference, Japanese Patent Application No. 2019-125329 filed on Jul. 4, 2019.

FIELD

The present invention relates to a connector and a method for manufacturing the connector.

BACKGROUND

A connector having what is called a coaxial or pseudo coaxial structure, which has a flat plate shape but is capable of improving transmission characteristics, has been conventionally mounted, for example, on a circuit board such as a flexible printed board, and has been used as a connector for transmitting signals such as high-frequency signals, which require excellent signal transmission characteristics.

As an example of this type of connector, there has been known a connector having a structure to achieve a male-female fit between a male connector and a female connector, in which each of the male and female connectors integrally fixes a grounded conductor at an outer side of a central conductor via an electric insulator (e.g., Patent Literature 1).

Patent Literature 1 discloses a method for manufacturing a connector, including separately fabricating a central conductor and a grounded conductor by a method such as punching and bending a metallic plate, and integrating the central conductor and the grounded conductor with an insert-molded resin, i.e., an electric insulator.

CITATION LIST

Patent Literature

Patent Literature 1: International Publication No. WO2017/212862

SUMMARY

Technical Problem

In the above-described conventional manufacturing method, however, the central conductor and the grounded conductor need to be fabricated separately, and insert molding of the resin to be the electric insulator needs to be performed with a relative position between the central conductor and the grounded conductor being set with high accuracy. This increases the number of steps, and thus makes the manufacturing method complicated. The manufacturing cost of the connector is increased accordingly.

Moreover, in the conventional structure in which mounting is performed by connecting the grounded conductor, which is disposed at the outer side of the central conductor via the electric insulator, to a land electrode (a grounded electrode) in a substrate; however, the grounded conductor is grounded at a position away from the central conductor. This may bring a disadvantage in terms of transmission characteristics.

The present invention has been made in view of the foregoing circumstances, and it is an object of the present invention to provide a connector having excellent transmission characteristics, and a method for manufacturing such a connector, by which a connector can be manufactured more easily than in the conventional techniques, and thus its manufacturing cost can be reduced.

Solution to Problem

An aspect of the present invention provides a method for manufacturing a connector including: a signal terminal; a grounded conductor having a shell portion arranged over a whole circumference of an area around the signal terminal so as to surround the signal terminal; and an electrically insulating housing that integrally fixes the signal terminal and the grounded conductor so as to be electrically insulated from each other, in which the signal terminal is electrically connected to a counterpart signal terminal by means of a fit between the connector and a counterpart connector. This manufacturing method includes: integrally forming, with an electrically conductive material, a conductor base member including a signal terminal portion to form the signal terminal, a grounded conductor portion to form the grounded conductor, a connecting portion for connecting between the signal terminal portion and the grounded conductor portion so as to integrate the signal terminal portion and the grounded conductor portion together, and the shell portion; integrally fixing the conductor base member to the housing; and cutting at least part of the connecting portion by a cutting means to configure the signal terminal portion as the signal terminal and configure the grounded conductor portion as the grounded conductor.

According to the manufacturing method of the aspect of the present invention, the connector having the signal terminal and the grounded conductor separated from each other can be obtained by integrally fixing the conductor base member to the housing, and then cutting at least part of the connecting portion of the conductor base member. Thus, the connector can be easily manufactured with less time and effort as compared to the conventional techniques. Moreover, since the signal terminal and the grounded conductor are integral with each other as a signal part at the start of manufacturing, the number of parts can be reduced as compared to the conventional techniques. Thus, the manufacturing method of the aspect of the present invention can reduce the manufacturing cost. Furthermore, since the signal terminal and the grounded conductor, which are obtained after the cutting of the connecting portion, are connected to each other via the connecting portion before the cutting, a relative position between the signal terminal and the grounded conductor can be set as designed and with high accuracy.

According to the manufacturing method of the aspect of the present invention, the signal terminal and the grounded conductor, which are obtained by cutting the connecting portion, can be disposed adjacent to each other. By mounting the connector with the signal terminal and the grounded conductor disposed adjacent to each other being connected to electrodes in a substrate, the connector having excellent transmission characteristics can be obtained.

The connector manufactured by the manufacturing method of the aspect of the present invention can effectively reduce signal leakage to the outside by the shielding effects of the shell portion of the grounded conductor.

In the method for manufacturing a connector according to the aspect of the present invention, the housing is provided with a through hole, capable of exposing the connecting portion and allowing the cutting means to reach the connecting portion, formed in advance through a region from one surface to the other surface of the housing.

According to this manufacturing method, in the cutting of the connecting portion in the conductor base member, only the connecting portion to be cut can be cut through the through hole without cutting the connecting portion together with the housing. Thus, the connecting portion can be cut easily.

In the method for manufacturing a connector according to the aspect of the present invention, the connecting portion is cut by action of pressure cutting made by the cutting means, and the connecting portion includes, at a surface on a side toward which the pressure is applied, a recess for reducing a thickness of the connecting portion to be smaller than a thickness of the signal terminal portion and the grounded conductor portion, and cutting is performed within an area corresponding to the recess.

According to this manufacturing method, when burr is generated along a cut edge of the cut connecting portion, the burr can be confined in the recess, thus preventing protrusion of the burr. As a result, when the connector is mounted by connecting a portion of the signal terminal and a portion of the grounded conductor, which are separated from each other by the cutting and opposed to each other, to electrodes in a substrate by means of soldering, for example, the connector can be properly mounted without the burr generated in the cutting interfering with the electrodes in the substrate.

Another aspect of the present invention provides a connector including: a signal terminal to be electrically connected to a counterpart signal terminal by a fit between the connector and a counterpart connector; a grounded conductor having a shell portion arranged over a whole circumference of an area around the signal terminal so as to surround the signal terminal; and an electrically insulating housing that integrally fixes the signal terminal and the grounded conductor so as to be electrically insulated from each other. The housing includes a through hole passing through the housing from one surface to the other surface. The signal terminal includes a signal terminal protrusion that protrudes into the through hole. The grounded conductor includes a grounded conductor protrusion that protrudes into the through hole so as to be adjacent to the signal terminal protrusion.

With such a configuration, the connector according to the aspect of the present invention can improve transmission characteristics by being mounted with the signal terminal protrusion and the grounded conductor protrusion, which are disposed adjacent to each other, being connected to electrodes in a substrate.

By mounting the connector according to the aspect of the present invention with the signal terminal protrusion and the grounded conductor protrusion being connected to electrodes in a substrate, the connected state can be visually checked through the through hole. Moreover, since the connector can be mounted on a substrate with the grounded conductor protrusion being grounded inside of the outer shape of the connector, the size (mounting size) of the connector including the mounted portion can be reduced.

The connector according to the aspect of the present invention can effectively reduce signal leakage to the outside by the shielding effects of the shell portion of the grounded conductor.

The aspects of the present invention can provide a connector having excellent transmission characteristics, and a method for manufacturing such a connector, by which a connector can be manufactured more easily than in the conventional techniques, and thus its manufacturing cost can be reduced.

DESCRIPTION OF EMBODIMENTS

Figure 1:
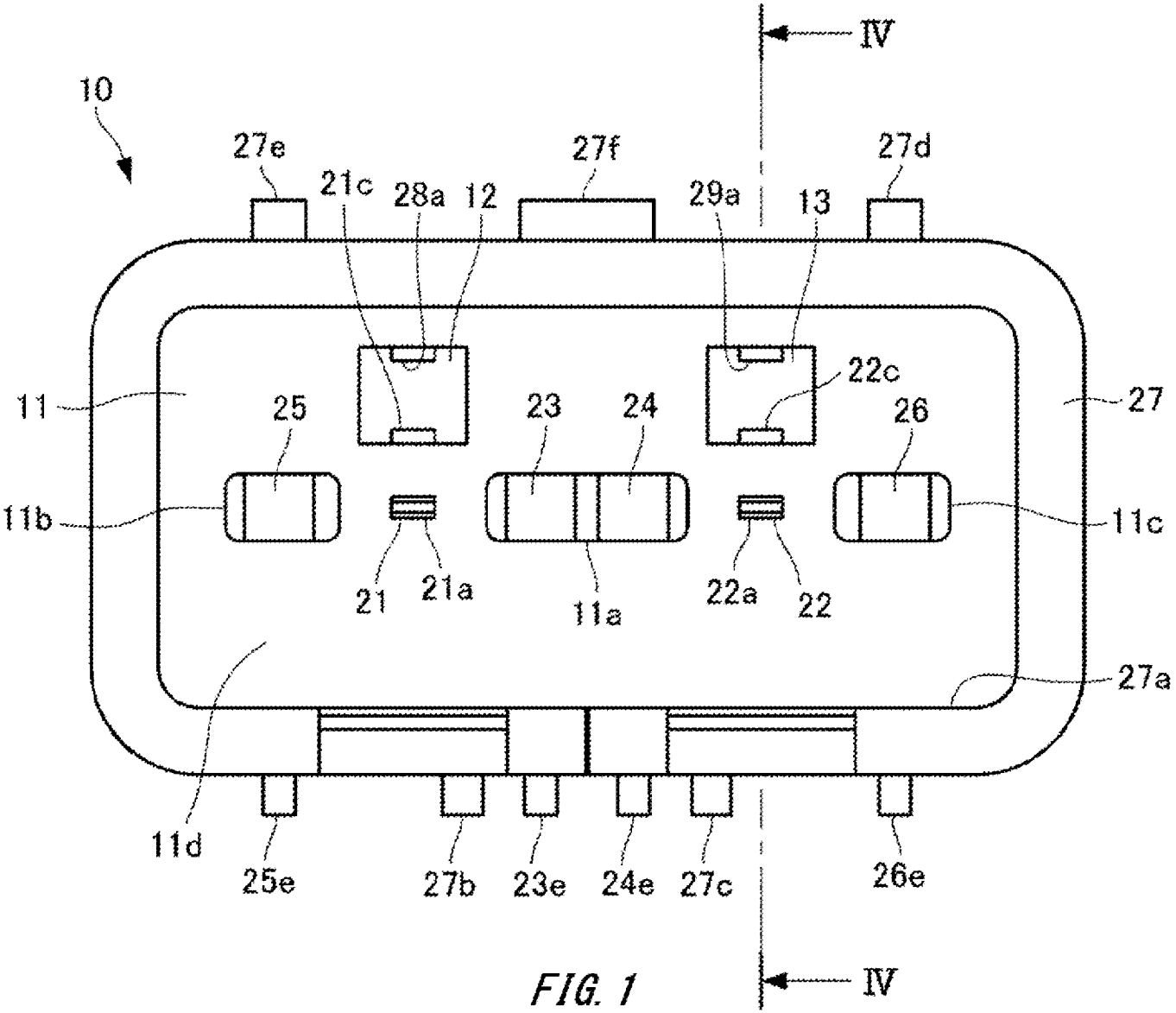
FIG. 1 is a plan view illustrating a plug according to an embodiment of the present invention.

An embodiment for carrying out the present invention will be described below.

Embodiment

FIGS. 1 to 4 are diagrams illustrating a plug 10 that constitutes a male connector according to the present embodiment, and FIGS. 6 to 9 are diagrams illustrating a receptacle 50 that constitutes a female connector, i.e., a counterpart connector into which the plug 10 is fitted. The plug 10 and the receptacle 50 are configured to achieve a male-female fit so that terminals included in the plug 10 come into contact with corresponding terminals included in the receptacle 50 to be electrically connected to each other.

Configurations of the plug 10 and the receptacle 50 will be described below, and then a method for manufacturing the plug 10 will be described.

Plug:

The plug 10 is configured in such a manner that central terminals 21 and 22, terminals 23, 24, 25, and 26, and a grounded conductor 27 are fixedly arranged in a generally planar fashion and at predetermined intervals in an electrically insulating housing 11 formed into a rectangular plate shape.

The central terminals 21 and 22 are terminals for transmitting high-frequency signals, and constitute signal terminals of the embodiment of the present invention. The terminals 23 to 26 are terminals for other uses. For example, the terminals 23 and 24 can be used for other signals excluding high-frequency signals, and the terminals 25 and 26 can be used for a power source. These uses, however, are given by way of example only, and the terminals 23 to 26 are not limited to such uses.

The housing 11 is obtained by forming a thermoplastic resin such as a liquid crystal polymer into a flat plate shape. The central terminals 21 and 22, the terminals 23 to 26, and the grounded conductor 27 are each formed into a predetermined shape, for example, by punching, and bending in a plate thickness direction, a plate-shaped electrically conductive material (e.g., a plate material made of a copper alloy such as phosphor bronze or a metal such as stainless steel).

The plug 10 according to the present embodiment is configured in such a manner that the central terminals 21 and 22, the terminals 23 to 26, and the grounded conductor 27 are electrically insulated from one another and integrally fixed in the insert-molded housing 11. A method to dispose and fix the central terminals 21 and 22, the terminals 23 to 26, and the grounded conductor 27 in and to the housing 11 so as to be electrically insulated from one another is not limited to the method by means of the insert molding of the housing 11. For example, the disposition and fixation of those components may be performed via bonding to a molded housing 11, press fitting into a molded housing 11, or a fit into a molded housing 11.

The housing 11 includes: a protrusion 11*a* disposed at the center, as well as protrusions 11*b* and 11*c* disposed on both sides of the protrusion 11*a*, which are formed in a central portion so as to be arranged in a line; a depression 11*d* disposed around these protrusions 11*a* to 11*c*; and a peripheral wall 11*e* surrounding the depression 11*d*.

The central terminal 21 is arranged between the protrusion 11*a* and the protrusion 11*b*, and the central terminal 22 is arranged between the protrusion 11*a* and the protrusion 11*c*.

The central terminals 21 and 22 each have the same L shape. The central terminals 21 and 22 have: lead portions 21*a* and 22*a* at one ends thereof, which protrude from a front surface 11*f* (the surface on the same side as the depression 11*d*) of the housing 11; and mounting portions 21*b* and 22*b* exposed on a bottom surface 11*g* of the housing 11 so as to be in the same plane as the bottom surface 11*g*. The front surface 11*f* and the bottom surface 11*g* of the housing 11 constitute one surface and the other surface of the embodiment of the present invention, respectively.

In the housing 11, rectangular through holes 12 and 13 passing through the housing 11 from the front surface 11*f* to the bottom surface 11*g* are provided to be adjacent to the central terminals 21 and 22, respectively, at positions corresponding to the central terminals 21 and 22 and disposed in a direction (upside in FIG. 1) in which the mounting portions 21*b* and 22*b* extend.

Figure 3:
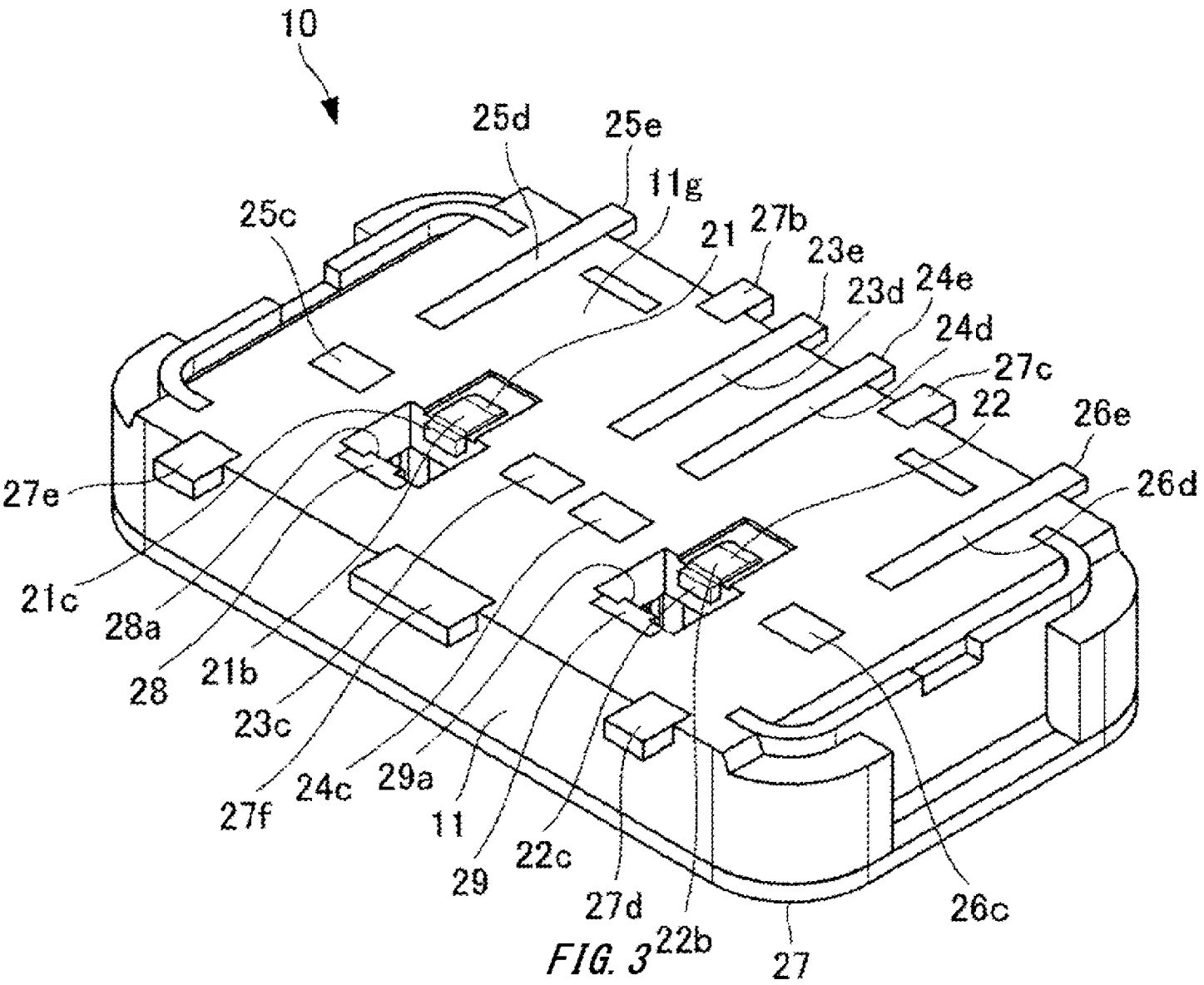
FIG. 3 is a perspective view showing a bottom surface side of the plug according to the embodiment of the present invention.

As shown in FIGS. 1 and 3, the central terminals 21 and 22 include central terminal protrusions 21*c* and 22*c*, which protrude into the through holes 12 and 13, at leading ends of the mounting portions 21*b* and 22*b*, respectively. These central terminal protrusions 21*c* and 22*c* constitute signal terminal protrusions of the embodiment of the present invention.

Figure 2A:
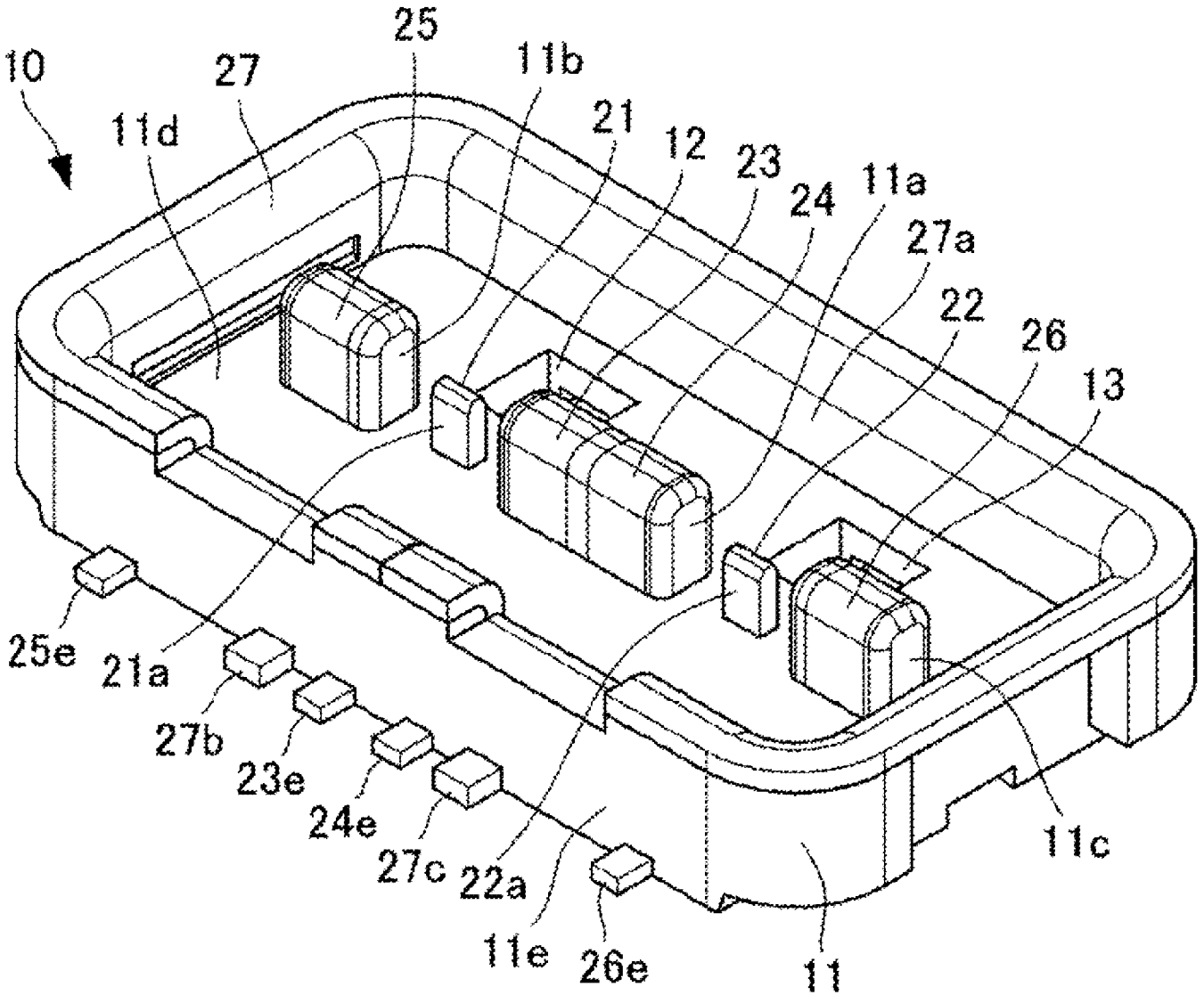
FIG. 2A is a perspective view showing, from one direction, a front surface side of the plug according to the embodiment of the present invention.
Figure 2B:
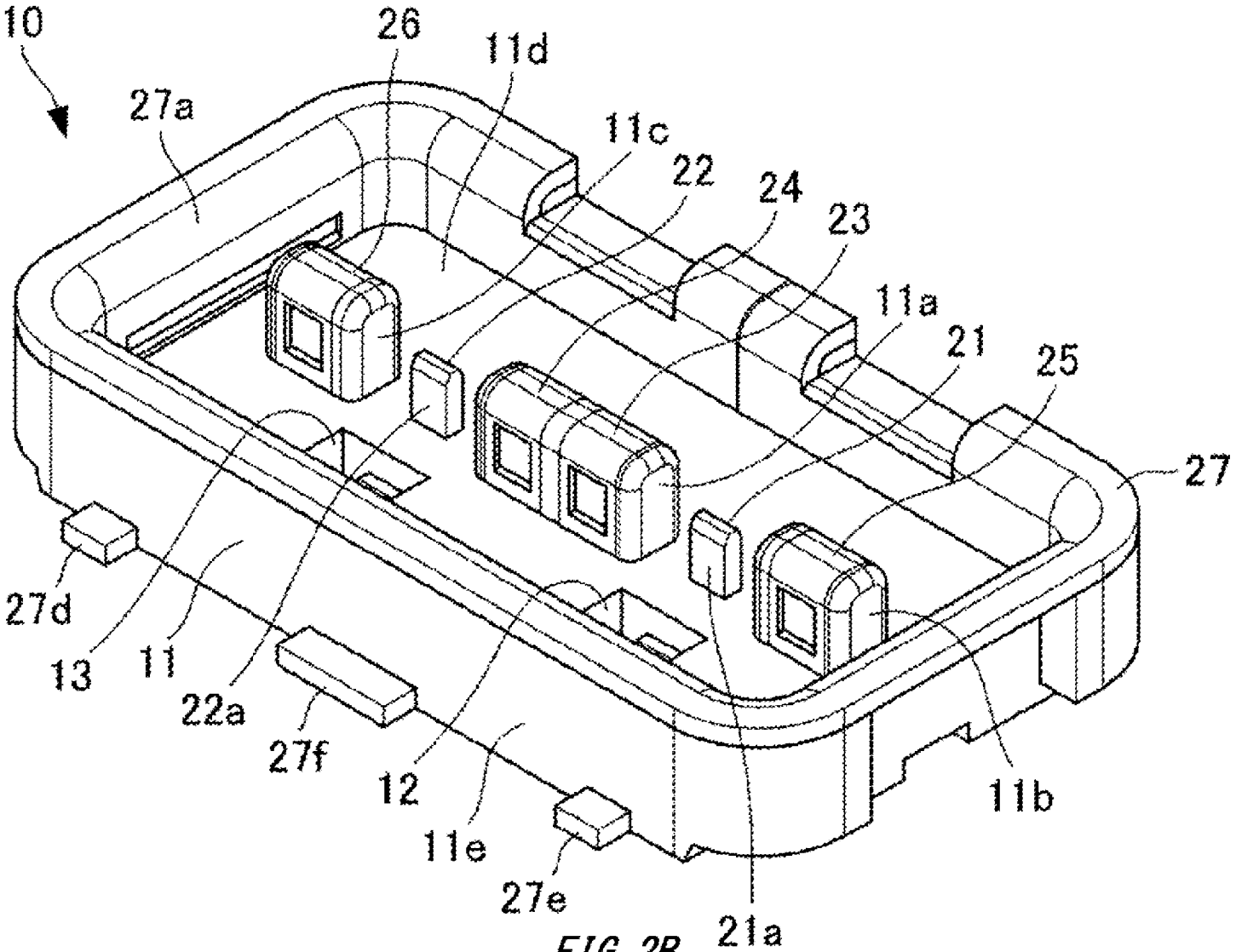
FIG. 2B is a perspective view showing, from the other direction, the front surface side of the same plug as that in FIG. 2A.

As shown in FIG. 1 and FIGS. 2A and 2B, the terminals 23 and 24 are provided to be spaced apart from each other in the protrusion 11*a* disposed at the center. The terminal 25 is provided in the protrusion 11*b*, and the terminal 26 is provided in the protrusion 11*c*.

Figure 5A:
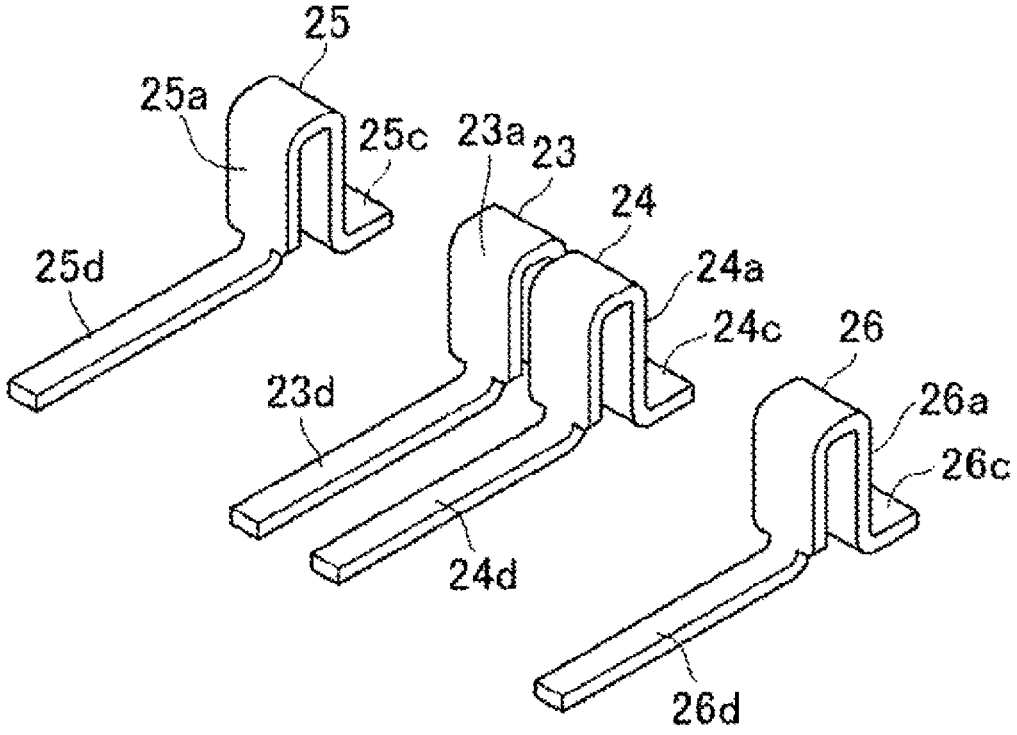
FIG. 5A is a perspective view showing, from the oblique direction corresponding to FIG. 2A, four terminals included in the plug according to the embodiment of the present invention.
Figure 5B:
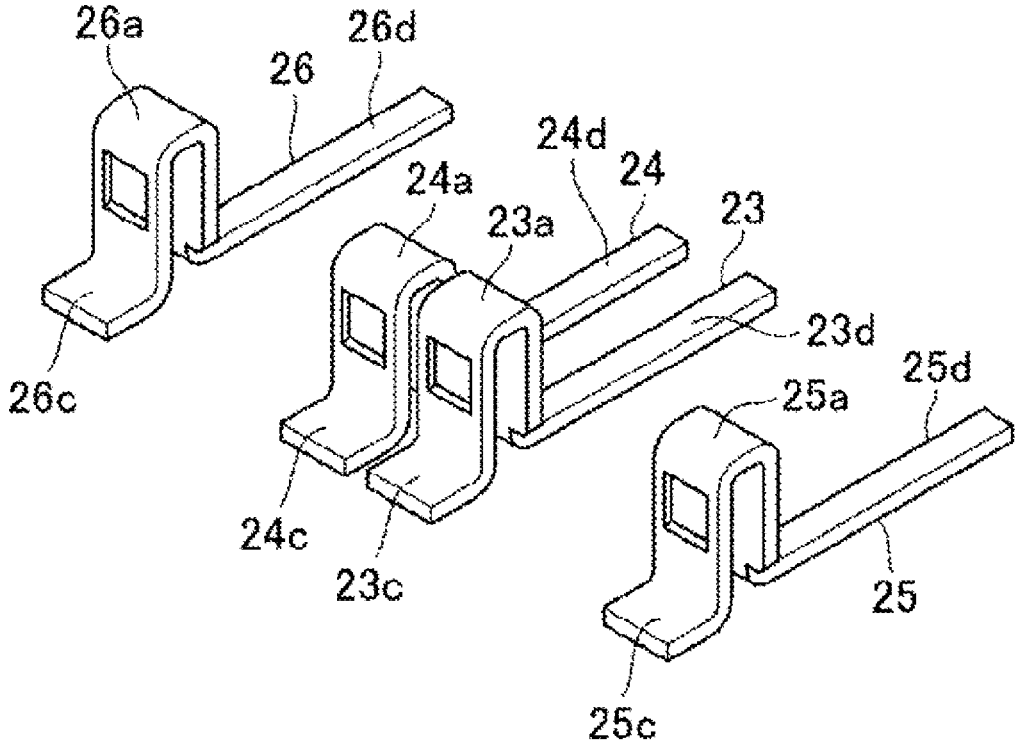
FIG. 5B is a perspective view showing, from the oblique direction corresponding to FIG. 2B, the four terminals.

As shown in FIGS. 5A and 5B, the terminals 23 to 26 are formed into the same shape, and include: fit portions 23*a*, 24*a*, 25*a*, and 26*a* to be fitted to the protrusions 11*a*, 11*b*, and 11*c*, respectively, in such a manner as to cover the protrusions 11*a*, 11*b*, and 11*c* externally; short plate portions 23*c*, 24*c*, 25*c*, and 26*c* extending from one ends of the fit portions 23*a*, 24*a*, 25*a*, and 26*a*, respectively; and long plate portions 23*d*, 24*d*, 25*d*, and 26*d* extending from the other ends of the fit portions 23*a*, 24*a*, 25*a*, and 26*a*, respectively. As shown in FIG. 3, the short plate portions 23*c* to 26*c* and the long plate portions 23*d* to 26*d* are exposed on the bottom surface 11*g* of the housing 11 so as to be in the same plane as the bottom surface 11*g*. Furthermore, the long plate portions 23*d*, 24*d*, 25*d*, and 26*d* include, at leading ends thereof, connection ends 23*e*, 24*e*, 25*e*, and 26*e* protruding outwardly from the housing 11 and serving as connection parts with a substrate on which the plug 10 is to be mounted.

Figure 4:
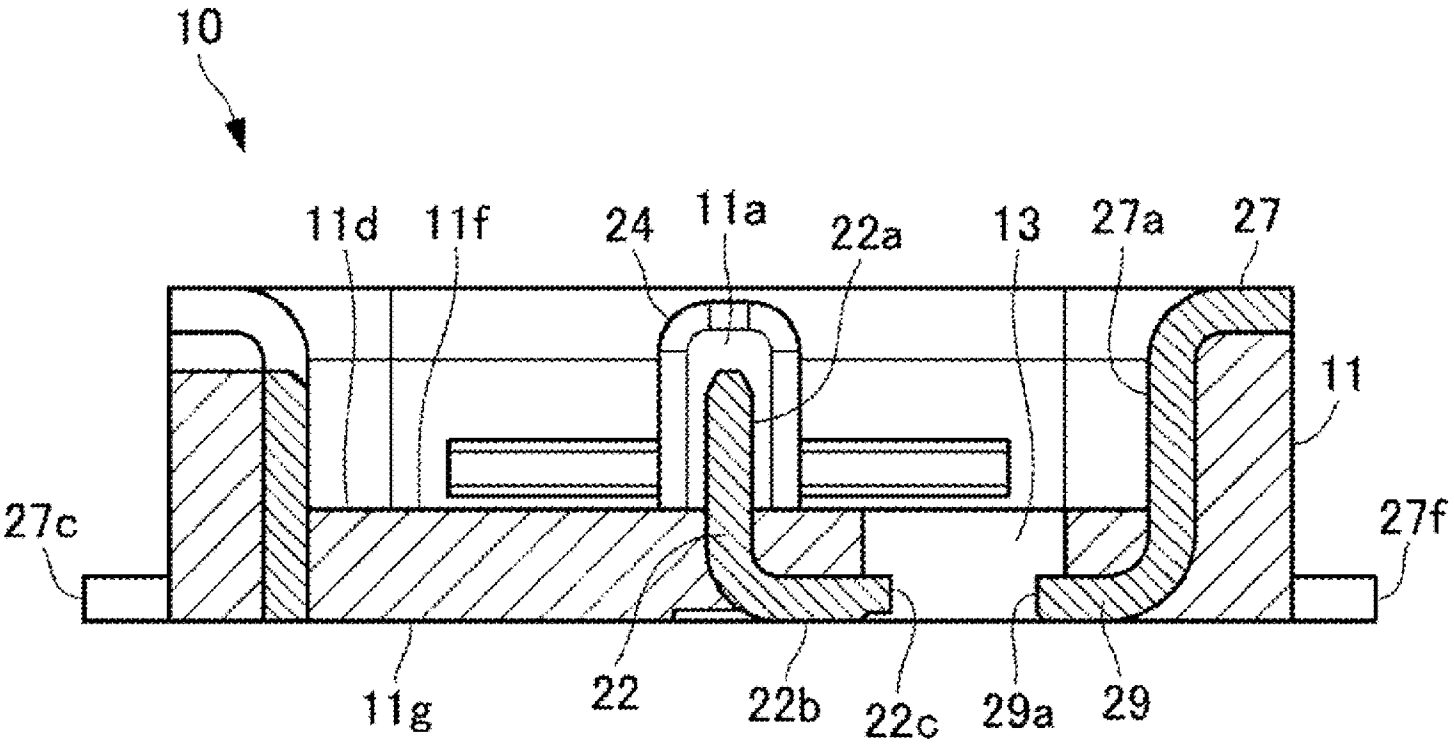
FIG. 4 is a cross-sectional view taken along line IV-IV in FIG. 1.

As shown in FIGS. 2A and 2B, the grounded conductor 27 includes: a shell portion 27*a* extending over the whole circumference of the peripheral wall 11*e* of the housing 11 along an inner surface and an open edge of the peripheral wall 11*e*; and connection portions 27*b*, 27*c*, 27*d*, 27*e*, and 27*f* protruding outwardly from the housing 11 and serving as connection parts with the substrate on which the plug 10 is to be mounted. As shown in FIGS. 3 and 4, the grounded conductor 27 further includes protruding pieces 28 and 29 extending inwardly toward the through holes 12 and 13 of the housing 11. The protruding pieces 28 and 29 include grounded conductor protrusions 28*a* and 29*a* protruded into the through holes 12 and 13, respectively. The grounded conductor protrusion 28*a* and the central terminal protrusion 21*c* are disposed adjacent to, and opposed to, each other with a small gap therebetween. The grounded conductor protrusion 29*a* and the central terminal protrusion 22*c* are disposed adjacent to, and opposed to, each other with a small gap therebetween.

The shell portion 27*a* is arranged over the whole circumference of an area around the central terminals 21 and 22 so as to surround the central terminals 21 and 22. A height of the shell portion 27*a* is preferably set so that the central terminals 21 and 22 at least fall within a range of such a height, i.e., the height of the shell portion 27*a* is greater than or equal to the height of the central terminals 21 and 22. The shell portion 27*a* is more preferably formed so as to be greater than the central terminals 21 and 22 in a vertical direction (the thickness direction of the plug 10).

The plug 10 according to the present embodiment includes: the grounded conductor 27 having the shell portion 27*a* arranged over the whole circumference of the area around the central terminals 21 and 22 so as to surround the central terminals 21 and 22; and the electrically insulating housing 11 in which the central terminals 21 and 22, the terminals 23 to 26, and the grounded conductor 27 are integrally fixed in a manner electrically insulated from one another. The housing 11 includes the through holes 12 and 13 passing therethrough from the front surface 11*f* to the bottom surface 11*g*. The central terminals 21 and 22 include the central terminal protrusions 21*c* and 22*c* protruded into the through holes 12 and 13, respectively. The grounded conductor 27 includes the grounded conductor protrusions 28*a* and 29*a* protruded into the through holes 12 and 13 so as to be adjacent to the central terminal protrusions 21*c* and 22*c*, respectively. In the plug 10 according to the present embodiment, the central terminals 21 and 22, and the shell portion 27*a* of the grounded conductor 27 together constitute a connector of a pseudo coaxial structure.

Receptacle:

The configuration of the receptacle 50 will be described next.

Figure 6:
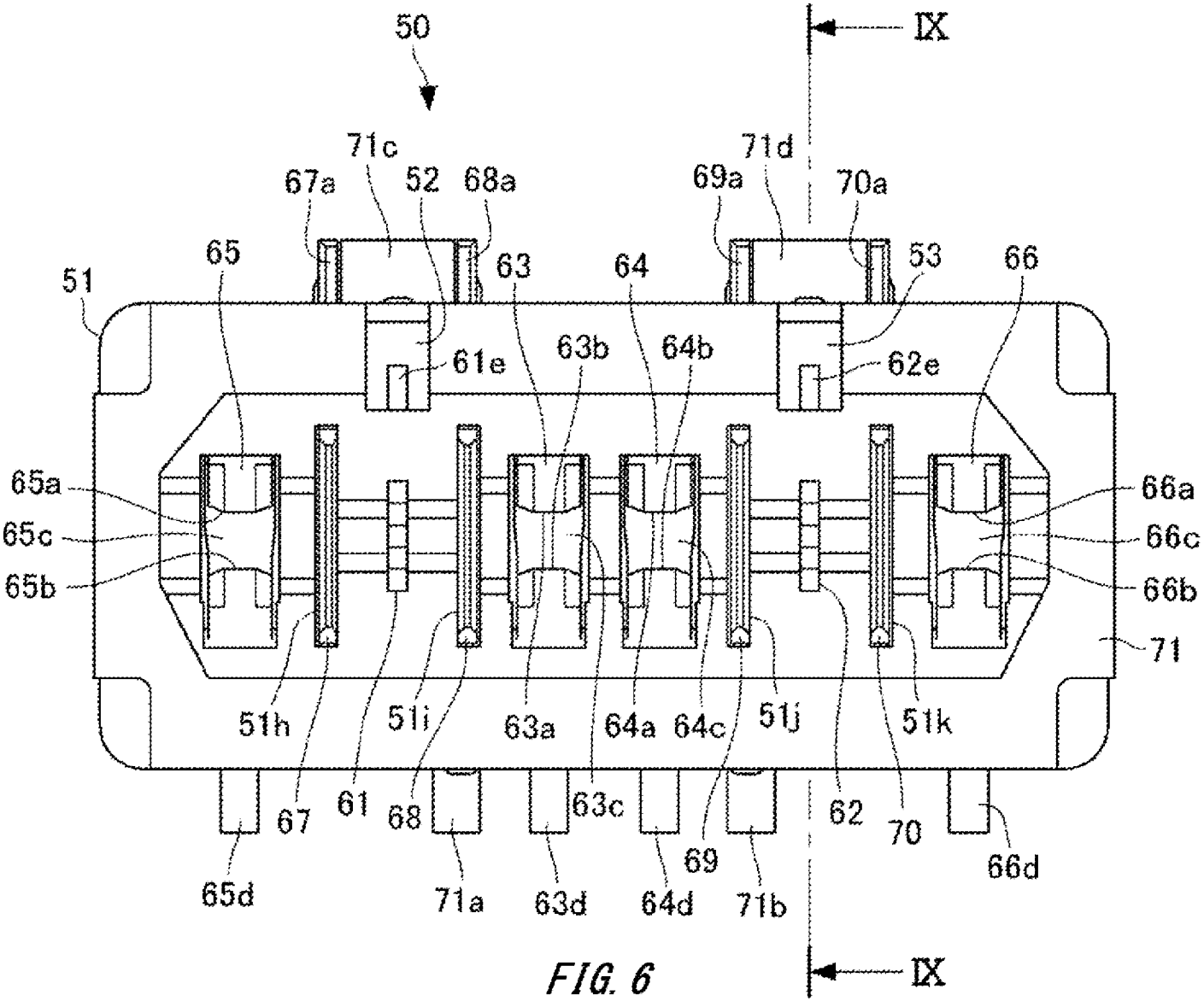
FIG. 6 is a plan view illustrating a receptacle according to the embodiment of the present invention.
Figure 7A:
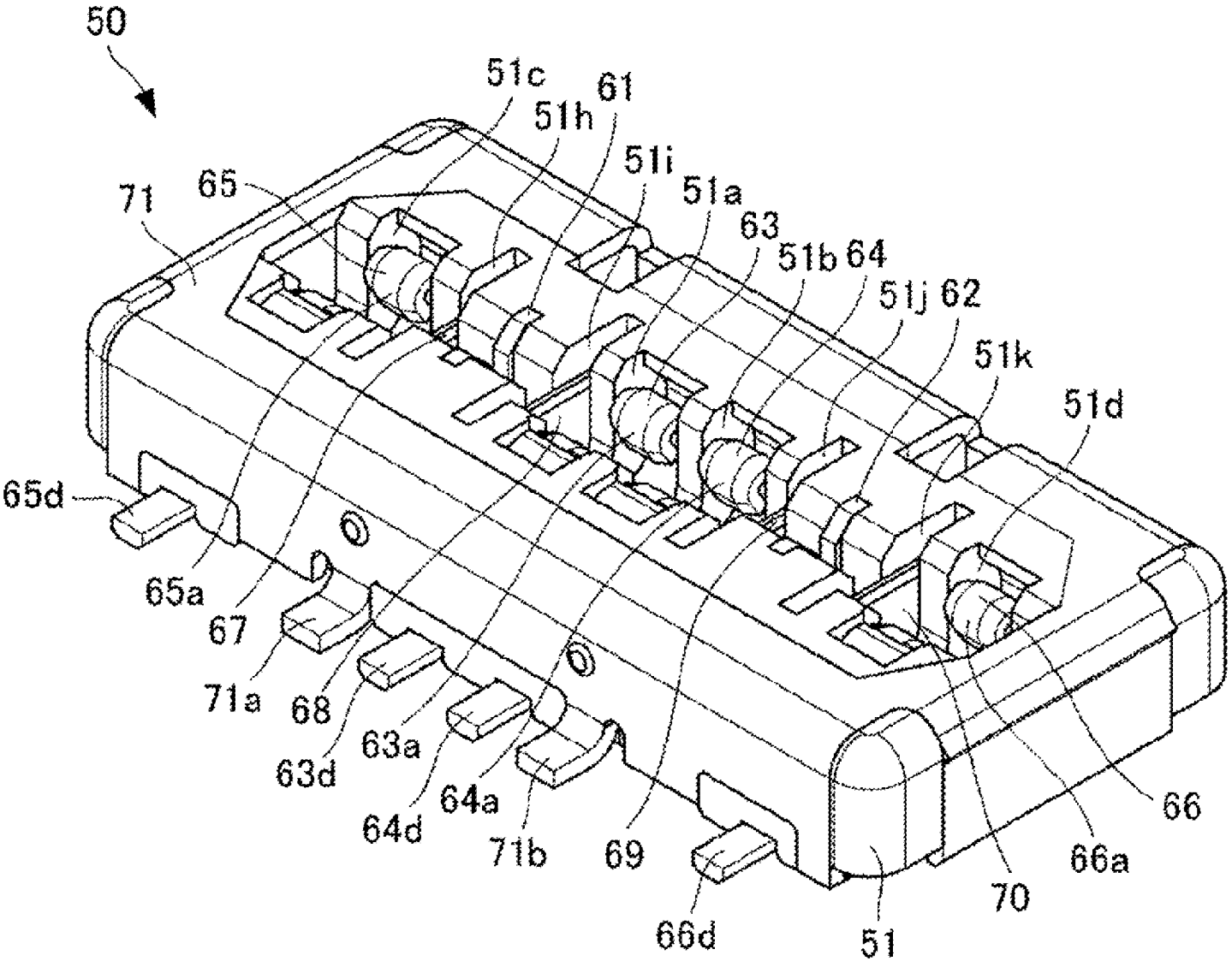
FIG. 7A is a perspective view showing, from one direction, a front surface side of the receptacle according to the embodiment of the present invention.
Figure 7B:
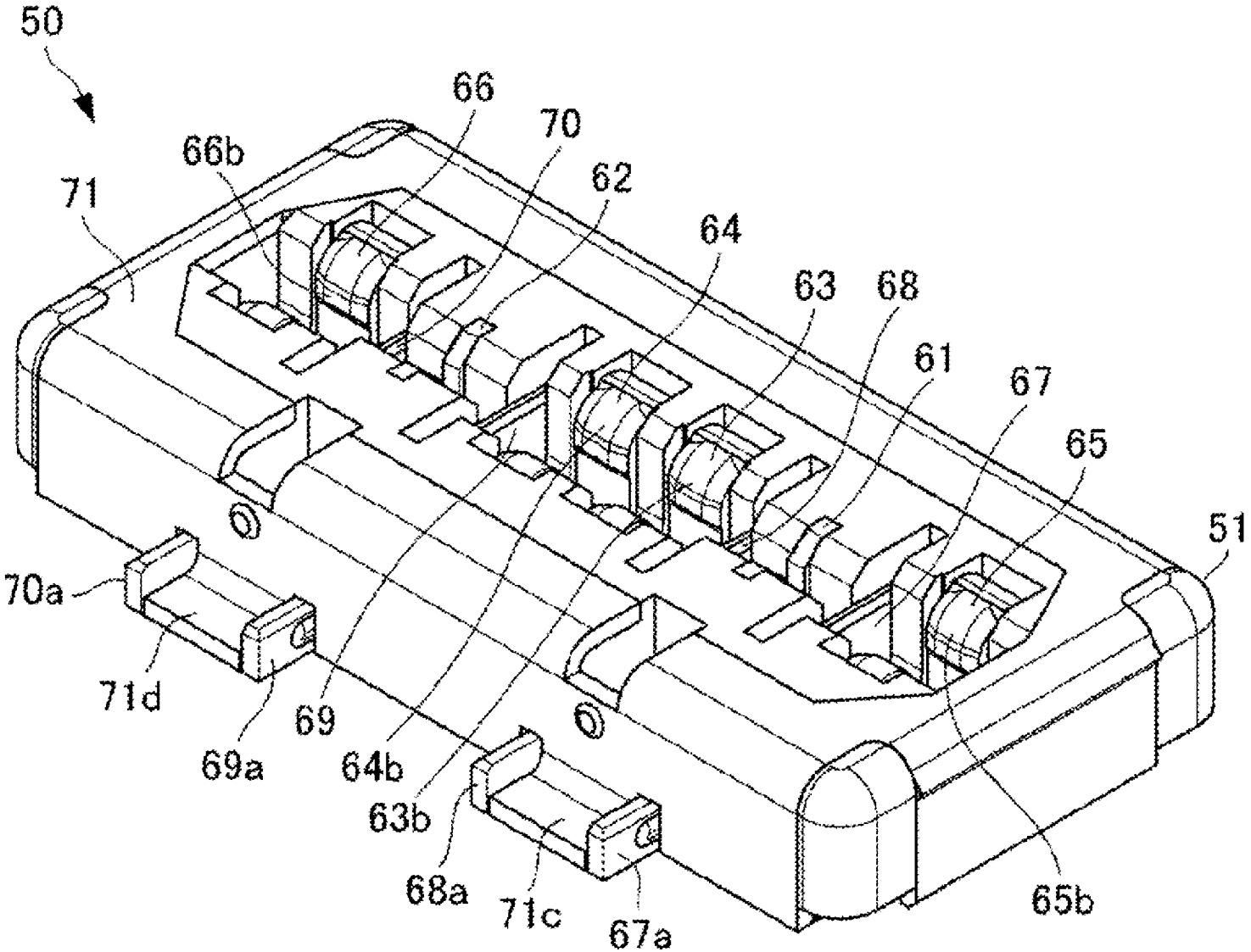
FIG. 7B is a perspective view showing, from the other direction, the front surface side of the same receptacle as that in FIG. 7A.

As shown in FIG. 6 and FIGS. 7A and 7B, the receptacle 50 is configured in such a manner that central terminals 61 and 62, terminals 63, 64, 65, and 66, grounded terminals 67, 68, 69, and 70, and a shell-shaped conductor 71 are fixedly arranged in a generally planar fashion and at predetermined intervals in an electrically insulating housing 51 formed into a rectangular plate shape.

The housing 51 is obtained by forming a thermoplastic resin such as a liquid crystal polymer into a flat plate shape. The central terminals 61 and 62, the terminals 63 to 66, the grounded terminals 67 to 70, and the shell-shaped conductor 71 are each formed into a predetermined shape, for example, by punching, and bending in a plate thickness direction as needed, a plate-shaped electrically conductive material (e.g., a plate material made of a copper alloy such as phosphor bronze or a metal such as stainless steel).

The central terminals 61 and 62 correspond to, and fit to, the central terminals 21 and 22 of the above-described plug 10, respectively. The central terminals 61 and 62 constitute counterpart signal terminals of the embodiment of the present invention. The terminals 63 to 66 are configured so as to correspond to, and fit to, the terminals 23 to 26 of the plug 10, respectively.

As shown in FIG. 7A, the terminals 63 to 66 are placed by being fitted into terminal fit holes 51*a*, 51*b*, 51*c*, and 51*d*, respectively, which are formed in the housing 51. The terminals 63 to 66 have the same shape. As shown in FIG. 6 and FIGS. 7A and 7B, the terminals 63 to 66 have pairs of opposed sandwiching surfaces 63*a* and 63*b*, 64*a* and 64*b*, 65*a* and 65*b*, and 66*a* and 66*b*, respectively, for sandwiching and coming into contact with the fit portions 23*a* to 26*a* of the terminals 23 to 26 in the plug 10 by respective plate surfaces thereof to hold their fit states. Fit holes 63*c*, 64*c*, 65*c*, and 66*c* into which the fit portions 23*a* to 26*a* of the terminals 23 to 26 are fitted are formed between the sandwiching surfaces 63*a* and 63*b*, 64*a* and 64*b*, 65*a* and 65*b*, and 66*a* and 66*b*, respectively. The terminals 63 to 66 also include connection ends 63*d*, 64*d*, 65*d*, and 66*d*, respectively, which protrude outwardly from the housing 11 and serve as connection parts with a substrate on which the receptacle 50 is to be mounted.

The central terminal 61 is arranged between the grounded terminal 67 and the grounded terminal 68, and the central terminal 62 is arranged between the grounded terminal 69 and the grounded terminal 70.

Figure 9:
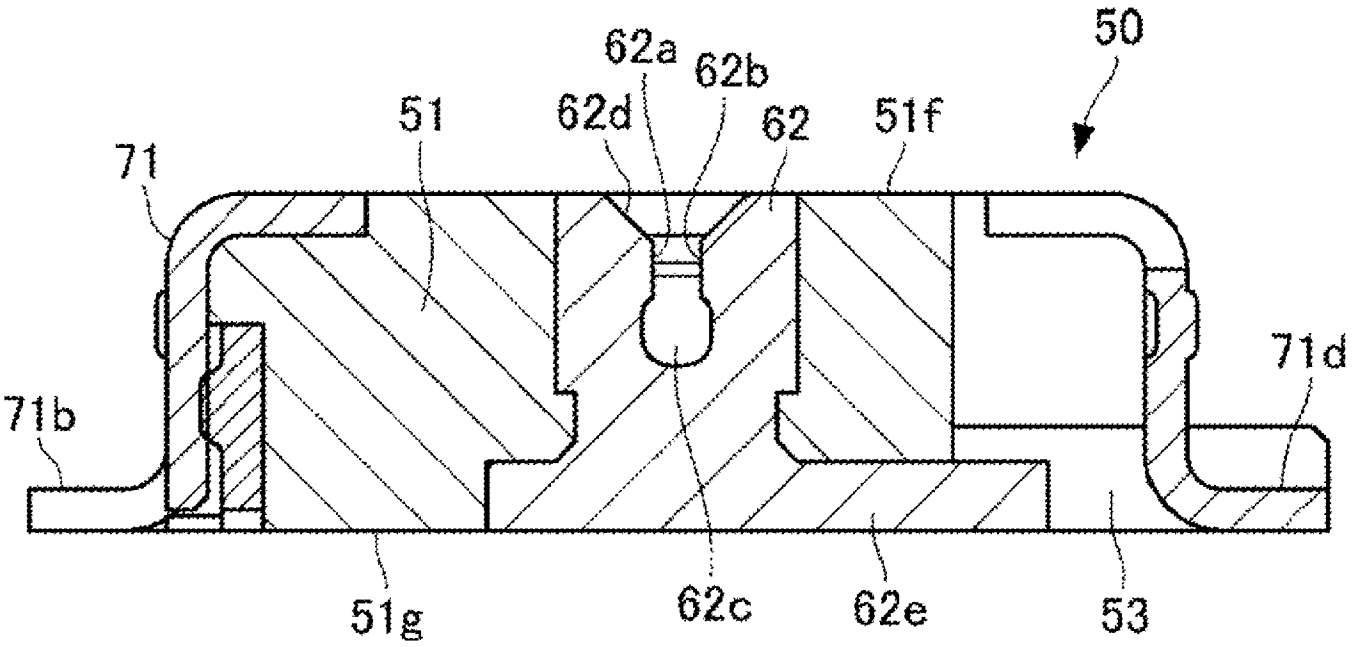
FIG. 9 is a cross-sectional view taken along line IX-IX in FIG. 6.

The central terminals 61 and 62 are formed into the same shape. Thus, only the central terminal 62 shown in FIG. 9 will be described below as a representative of such central terminals. As shown in FIG. 9, the central terminal 62 includes a pair of opposed sandwiching surfaces 62*a* and 62*b* for sandwiching and coming into contact with the lead portion 22*a* of the central terminal 22 in the above-described plug 10 to hold a fit state therebetween. The central terminal 62 also includes a fit hole 62*c*, formed inward (downside in FIG. 9) of an area between the sandwiching surfaces 62*a* and 62*b*, into which a leading end of the lead portion 22*a* is fitted.

The central terminal 62 has an opening 62*d*, formed in a funnel shape as viewed from the side thereof, for facilitating the insertion of the lead portion 22*a* into the fit hole 62*c*.

As mentioned above, the central terminal 61 has the same shape as the central terminal 62. Although not shown in the figures, the central terminal 61 also includes: a pair of opposed sandwiching surfaces for sandwiching and coming into contact with the lead portion 21*a* of the central terminal 21 of the plug 10 to hold a fit state therebetween; a fit hole into which a leading end of the lead portion 21*a* is fitted; and an opening, formed in a funnel shape as viewed from the side thereof, for facilitating the insertion of the lead portion 21*a* into the fit hole.

Figure 8:
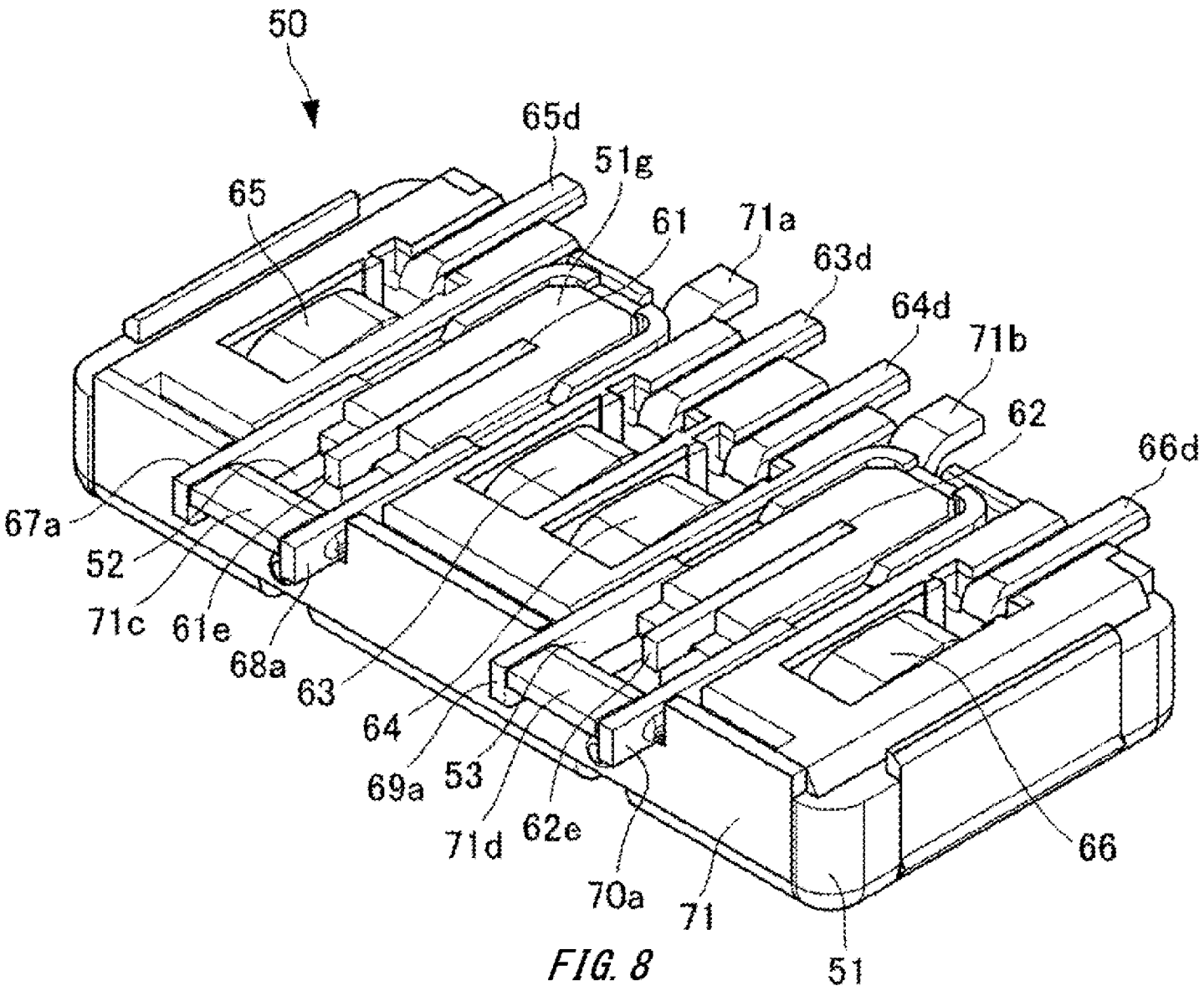
FIG. 8 is a perspective view showing a bottom surface side of the receptacle according to the embodiment of the present invention.

As shown in FIG. 8, the central terminals 61 and 62 include mounting portions 61*e* and 62*e*, respectively, which are exposed on a bottom surface 51*g* of the housing 51 so as to be in the same plane as the bottom surface 51*g*. Leading ends of the mounting portions 61*e* and 62*e* protrude into through holes 52 and 53, respectively, which are formed so as to pass through the housing 51 from a front surface 51*f* to the bottom surface 51*g*. By connecting the leading ends of the mounting portions 61*e* and 62*e*, which are protruded into the through holes 52 and 53, to terminals of the substrate on which the receptacle 50 is mounted by means of soldering, for example, such a connected state can be visually checked via the through holes 52 and 53.

The central terminals 61 and 62 are integrally fixed to the housing 51 by means of insert molding, for example.

As shown in FIG. 6 and FIGS. 7A and 7B, the grounded terminals 67 to 70 are each formed into a flat plate shape. The grounded terminals 67 to 70 are fitted into grounded terminal fit holes 51*h*, 51*i*, 51*j*, and 51*k*, respectively, which are formed in the housing 51, so that plate surfaces of the grounded terminals 67 to 70 extend perpendicular to a direction along which the central terminals 61 and 62 and the terminals 63 to 66 are arranged in a line. The grounded terminals 67 to 70 also include connection ends 67*a*, 68*a*, 69*a*, and 70*a*, respectively, which protrude outwardly from the housing 51 and serve as connection parts with the substrate on which the receptacle 50 is to be mounted.

The shell-shaped conductor 71 is formed in a generally rectangular shape so as to be continuous over the whole circumference of an outer peripheral portion of the housing 51. The shell-shaped conductor 71 has a shape to surround the outer periphery of the housing 51 except for four corners of the housing 51. The shell-shaped conductor 71 is arranged over the whole circumference of an area around the central terminals 61 and 62 so as to surround the central terminals 61 and 62. A height of the shell-shaped conductor 71 is preferably set so that the central terminals 61 and 62 at least fall within a range of such a height, i.e., the height of the shell-shaped conductor 71 is greater than or equal to the height of the central terminals 61 and 62. The shell-shaped conductor 71 is more preferably formed so as to be greater than the central terminals 61 and 62 in a vertical direction (the thickness direction of the receptacle 50).

The shell-shaped conductor 71 includes: connection ends 71*a* and 71*b* to be connected to the substrate on which the receptacle 50 is to be mounted; a connection end 71*c* to be connected to the substrate on which the receptacle 50 is to be mounted together with the grounded terminals 67 and 68; and a connection end 71*d* to be connected to the substrate on which the receptacle 50 is to be mounted together with the grounded terminals 69 and 70. The shell-shaped conductor 71 is integrally placed over the housing 51 by means of insert molding, for example.

In the receptacle 50 according to the present embodiment, the central terminals 61 and 62, and the shell-shaped conductor 71 together constitute a connector of a pseudo coaxial structure.

Figure 10:
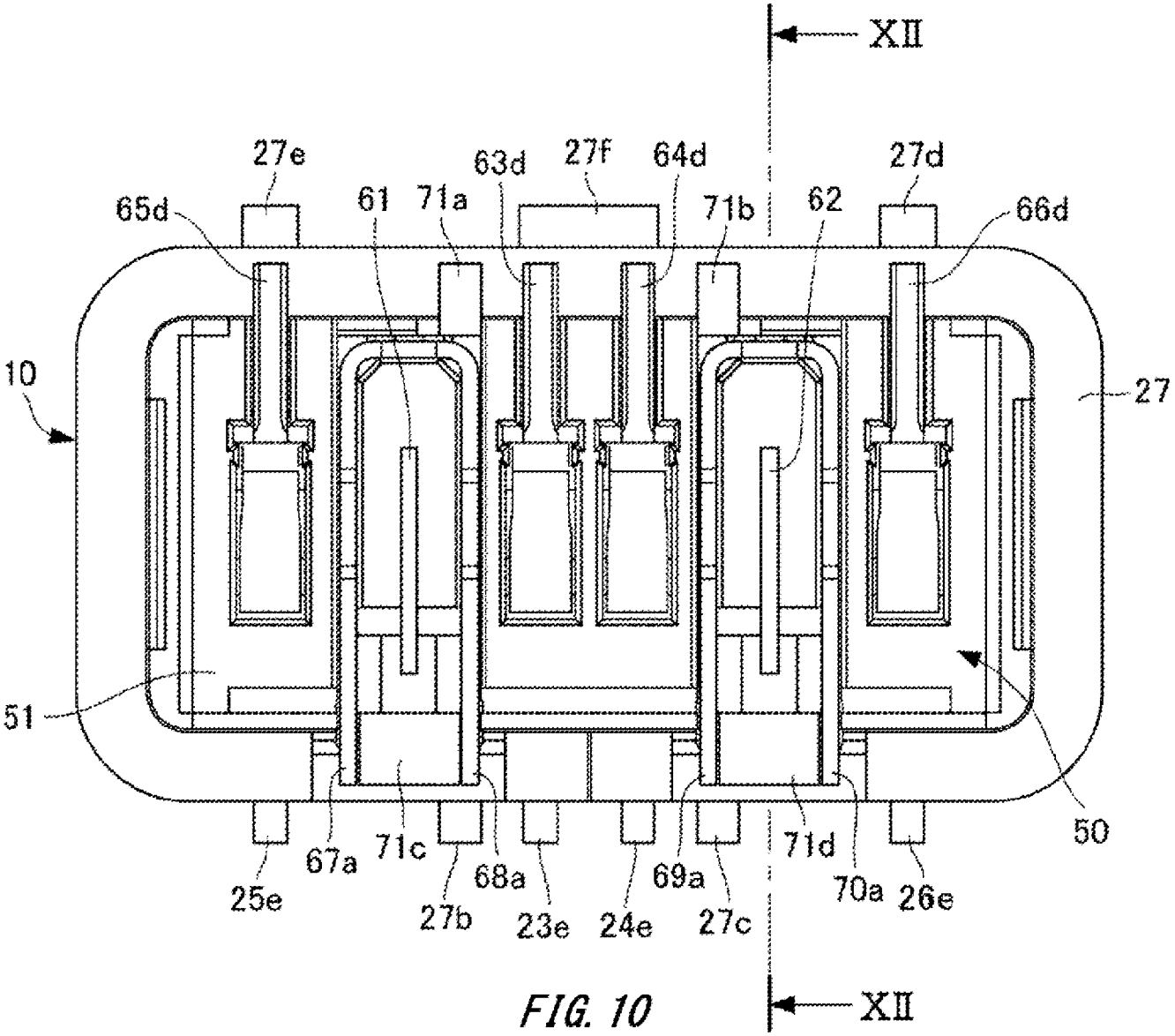
FIG. 10 is a plan view illustrating a fit state between the plug and the receptacle according to the embodiment of the present invention.
Figure 11:
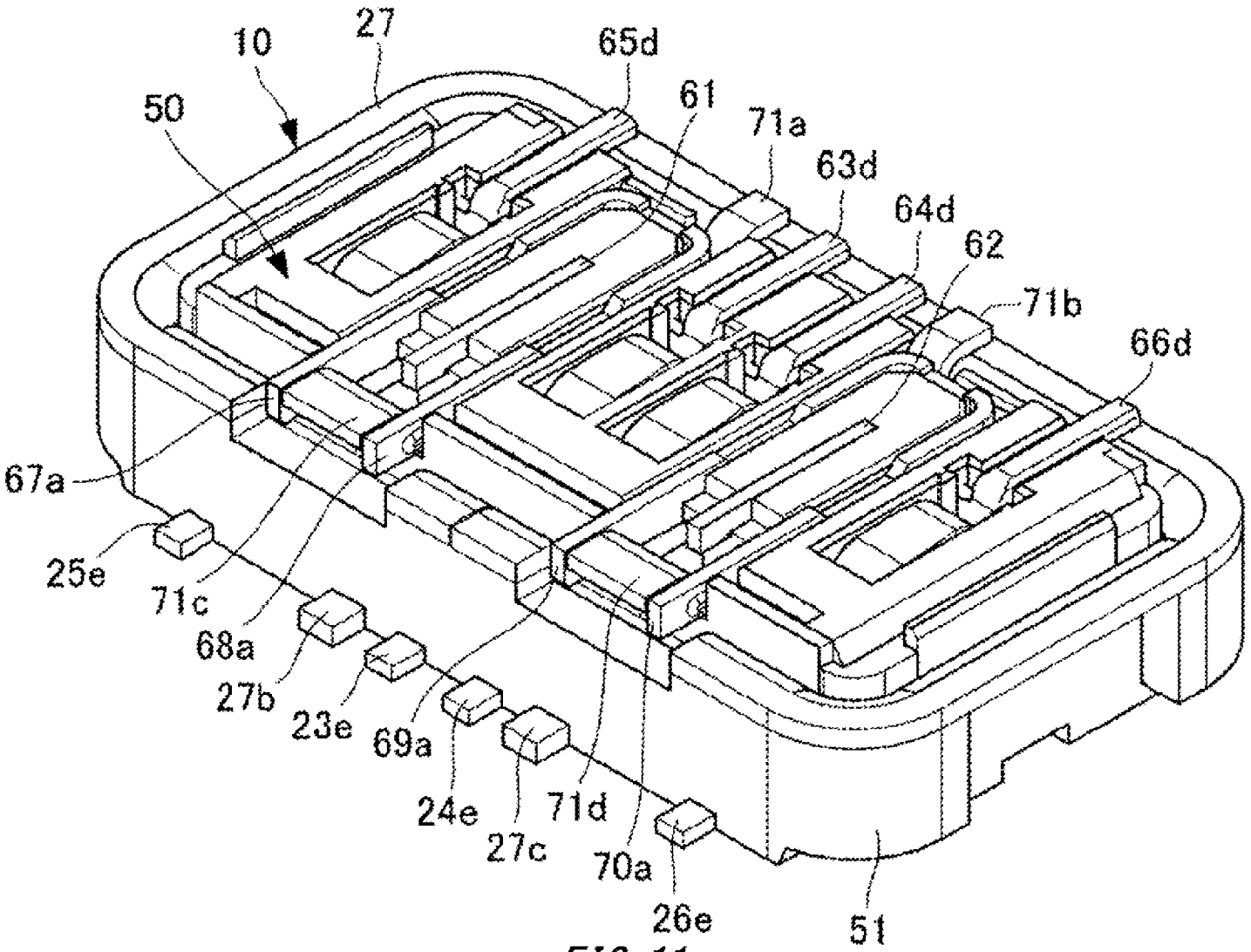
FIG. 11 is a perspective view illustrating the fit state between the plug and the receptacle according to the embodiment of the present invention.
Figure 12:
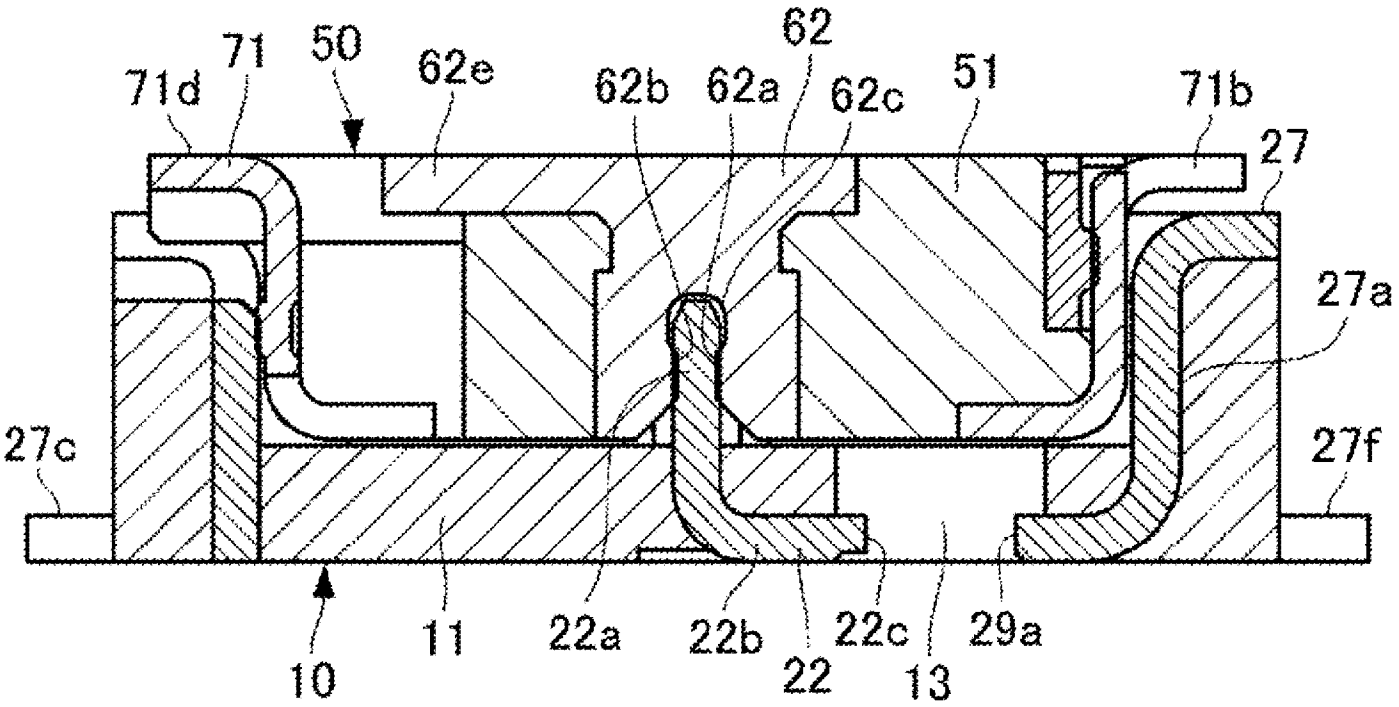
FIG. 12 is a cross-sectional view taken along line XII-XII in FIG. 10.

Fit Between Plug and Receptacle:

The plug 10 and the receptacle 50 described above are fitted to each other as shown in FIGS. 10 to 12. In such a fit state, the lead portion 22*a* of the central terminal 22 in the plug 10 is fitted into the fit hole 62*c* of the central terminal 62 in the receptacle 50, so that the lead portion 22*a* is sandwiched between the sandwiching surfaces 62*a* and 62*b* of the central terminal 62 and thus the lead portion 22*a* is in contact with the sandwiching surfaces 62*a* and 62*b* to achieve electrical conduction therebetween as shown in FIG. 12. Such a fit configuration between the central terminal 22 and the central terminal 62 is similarly applied to a fit between the other central terminal 21 and the other central terminal 61.

The fit portions 23*a* to 26*a* of the terminals 23 to 26 in the plug 10 are fitted into the fit holes 63*c* to 66*c* of the terminals 63 to 66 in the receptacle 50, respectively, so that the fit portions 23*a* to 26*a* are in contact with the sandwiching surfaces 63*a* and 63*b*, 64*a* and 64*b*, 65*a* and 65*b*, and 66*a* and 66*b*, respectively, to achieve electrical conduction therebetween.

Method for Manufacturing Plug:

A method for manufacturing the above-described plug 10 will be described next.

Figure 13:
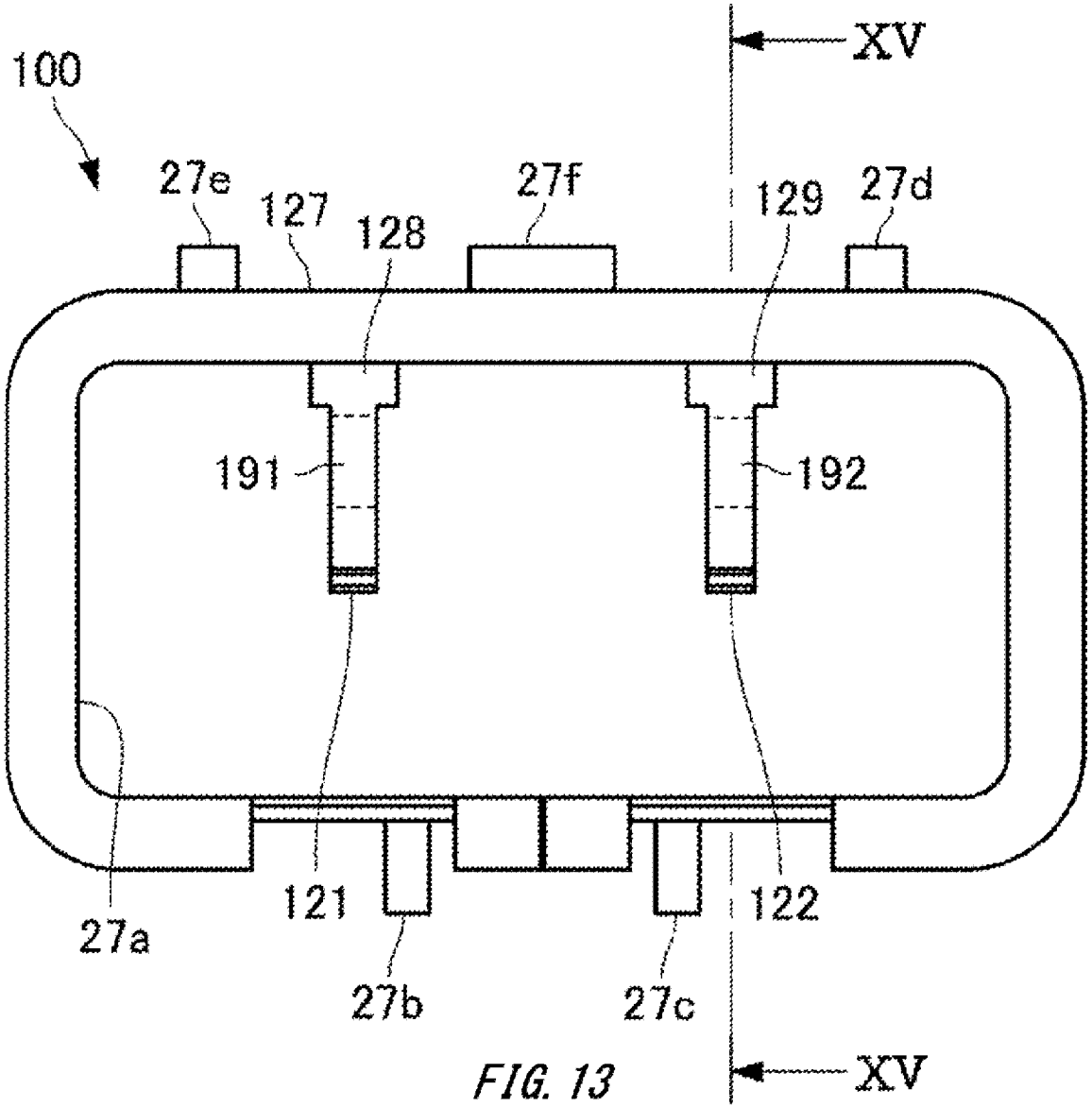
FIG. 13 is a plan view illustrating a conductor base member used in a method for manufacturing a plug according to the embodiment of the present invention.
Figure 14A:
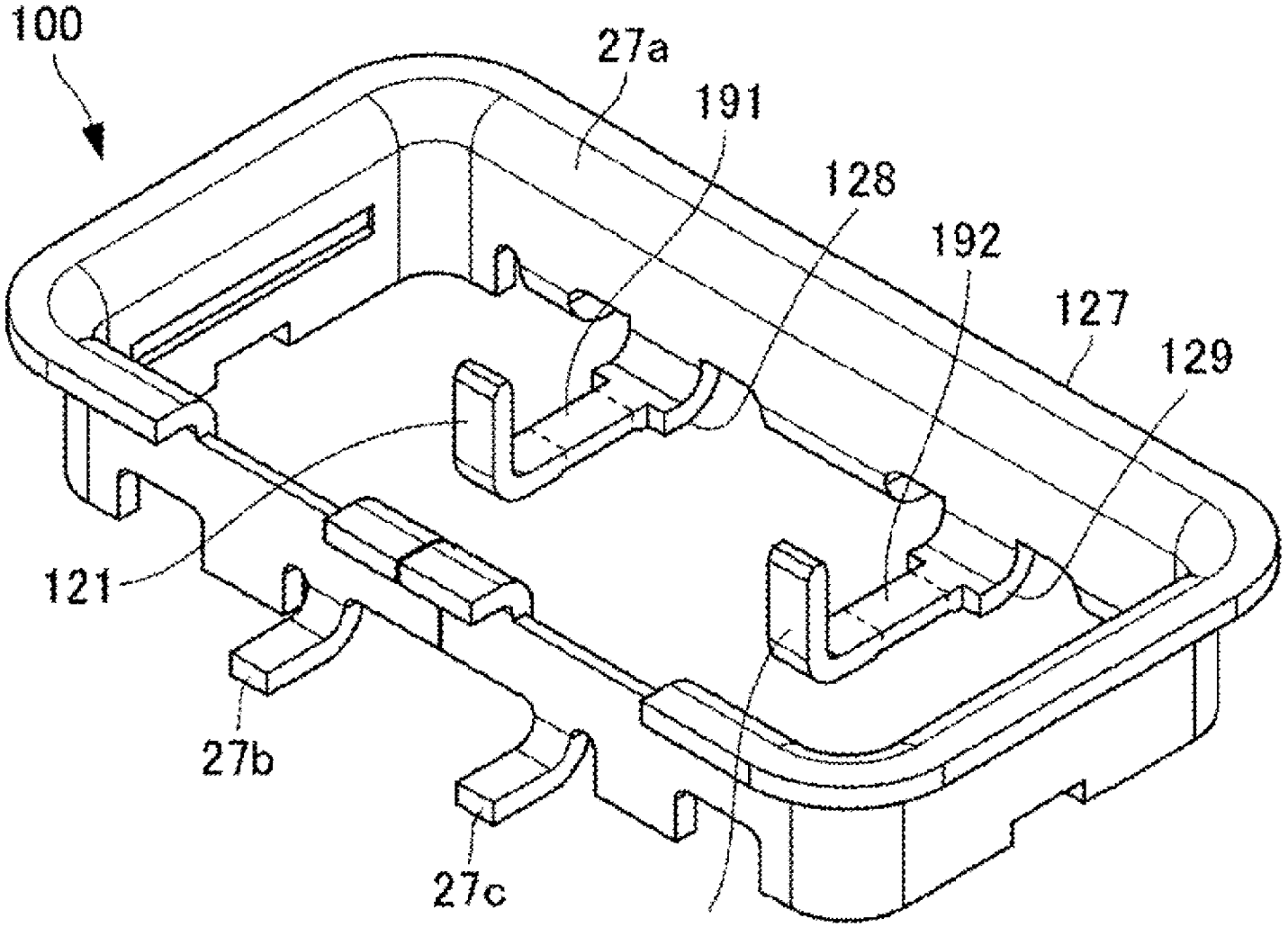
FIG. 14A is a perspective view showing a front surface side of the conductor base member used in the method for manufacturing a plug according to the embodiment of the present invention.
Figure 14B:
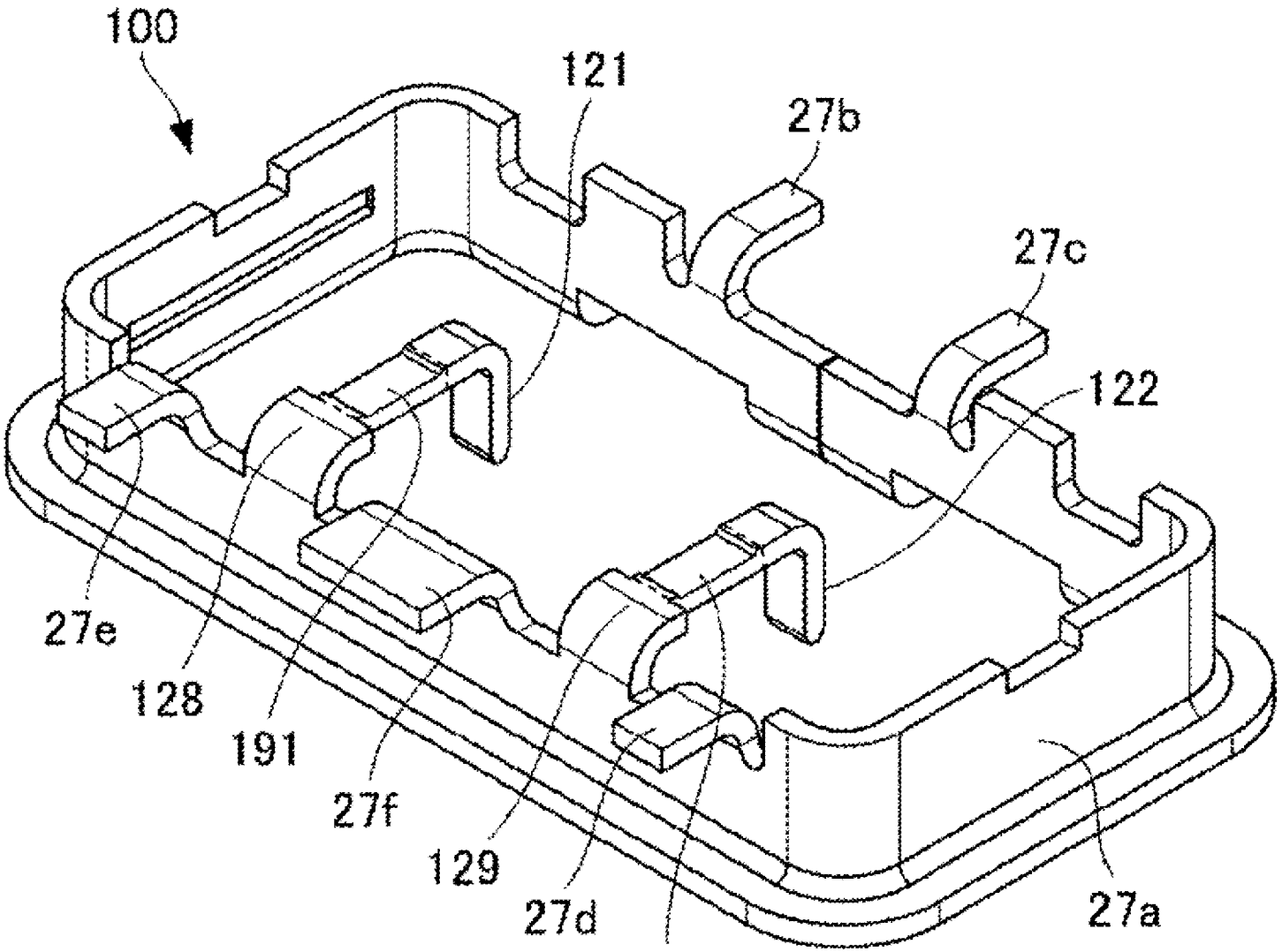
FIG. 14B is a perspective view showing a bottom surface side of the same conductor base member as that in FIG. 14A.
Figure 15:
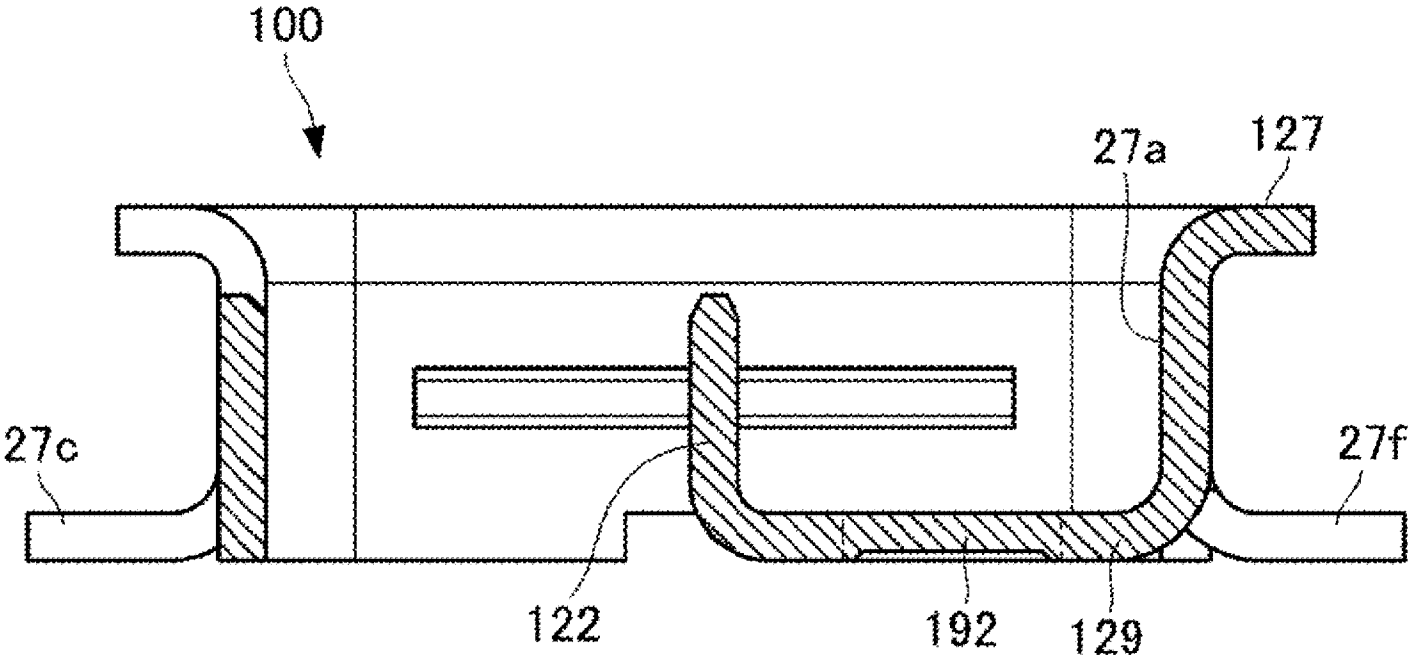
FIG. 15 is a cross-sectional view taken along line XV-XV in FIG. 13.

In the method for manufacturing the plug 10 according to the present embodiment, a conductor base member 100 shown in FIGS. 13 to 15 is fabricated first, for example, by punching and bending a metallic plate made of an electrically conductive material (the above-described plate material made of a copper alloy such as phosphor bronze or stainless steel).

The conductor base member 100 includes: central terminal portions 121 and 122 to form the central terminals 21 and 22 in the plug 10; a grounded conductor portion 127 to form the grounded conductor 27; and connecting portions 191 and 192 for connecting between the central terminal portions 121 and 122 and the grounded conductor portion 127. That is, in the conductor base member 100, three parts, i.e., two central terminals 21 and 22 and a single grounded conductor 27, are integrally formed as a single part via the connecting portions 191 and 192. In FIGS. 13 to 15, boundaries between the central terminal portions 121 and 122 and the connecting portions 191 and 192 as well as boundaries between the grounded conductor portion 127 and the connecting portions 191 and 192 are indicated by broken lines.

The grounded conductor portion 127 of the conductor base member 100 includes protruding piece portions 128 and 129 to form the protruding pieces 28 and 29 of the grounded conductor 27 in the plug 10. In the conductor base member 100, the protruding piece portion 128 and the central terminal portion 121 are connected to each other via the connecting portion 191, and the protruding piece portion 129 and the central terminal portion 122 are connected to each other via the connecting portion 192. The conductor base member 100 is also provided with the shell portion 27*a*, and the connection portions 27*b*, 27*c*, 27*d*, 27*e*, and 27*f* in the grounded conductor 27.

Figure 16:
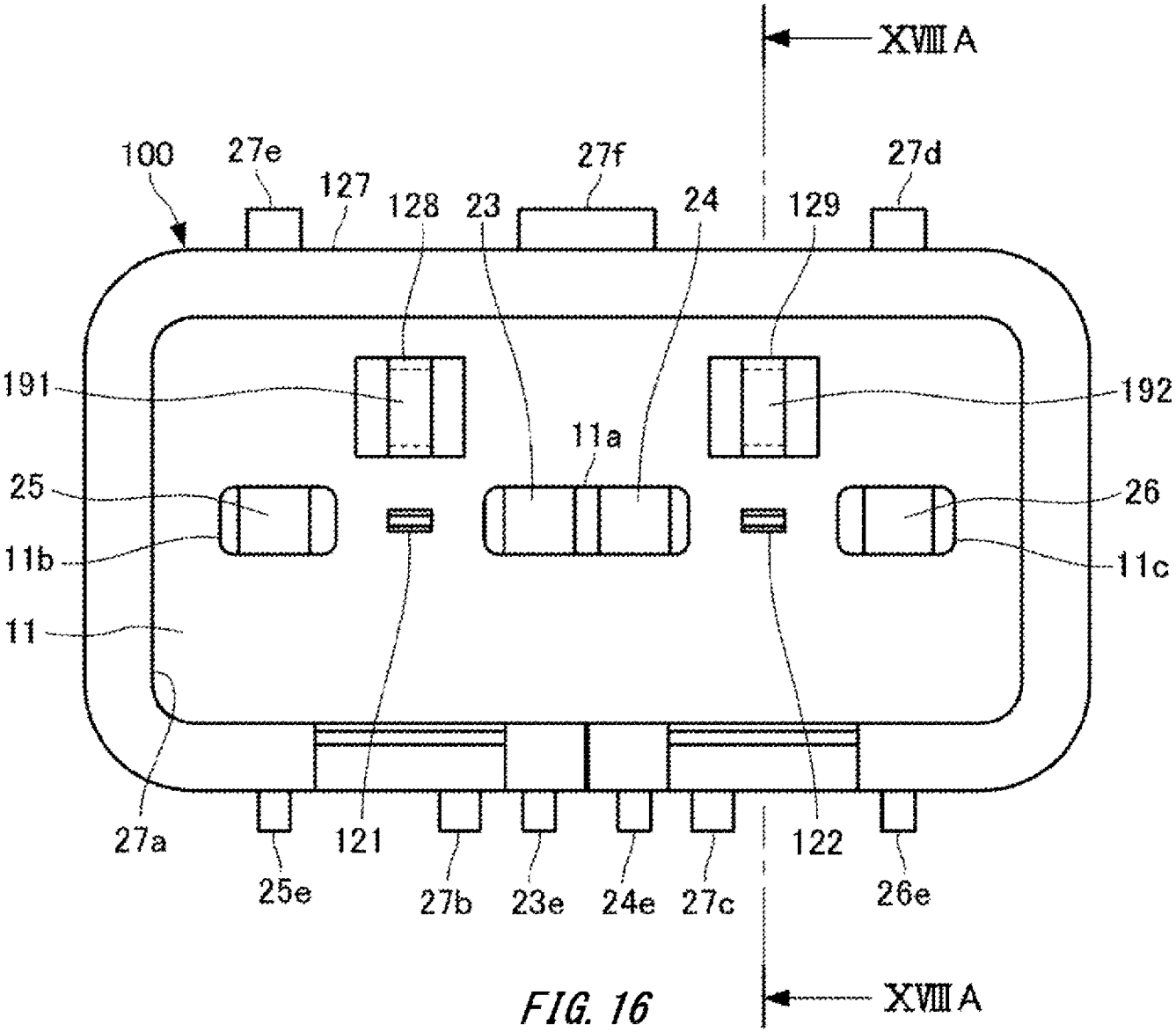
FIG. 16 is a plan view showing a state in which the conductor base member is fixed to a housing in the method for manufacturing a plug according to the embodiment of the present invention.
Figure 17:
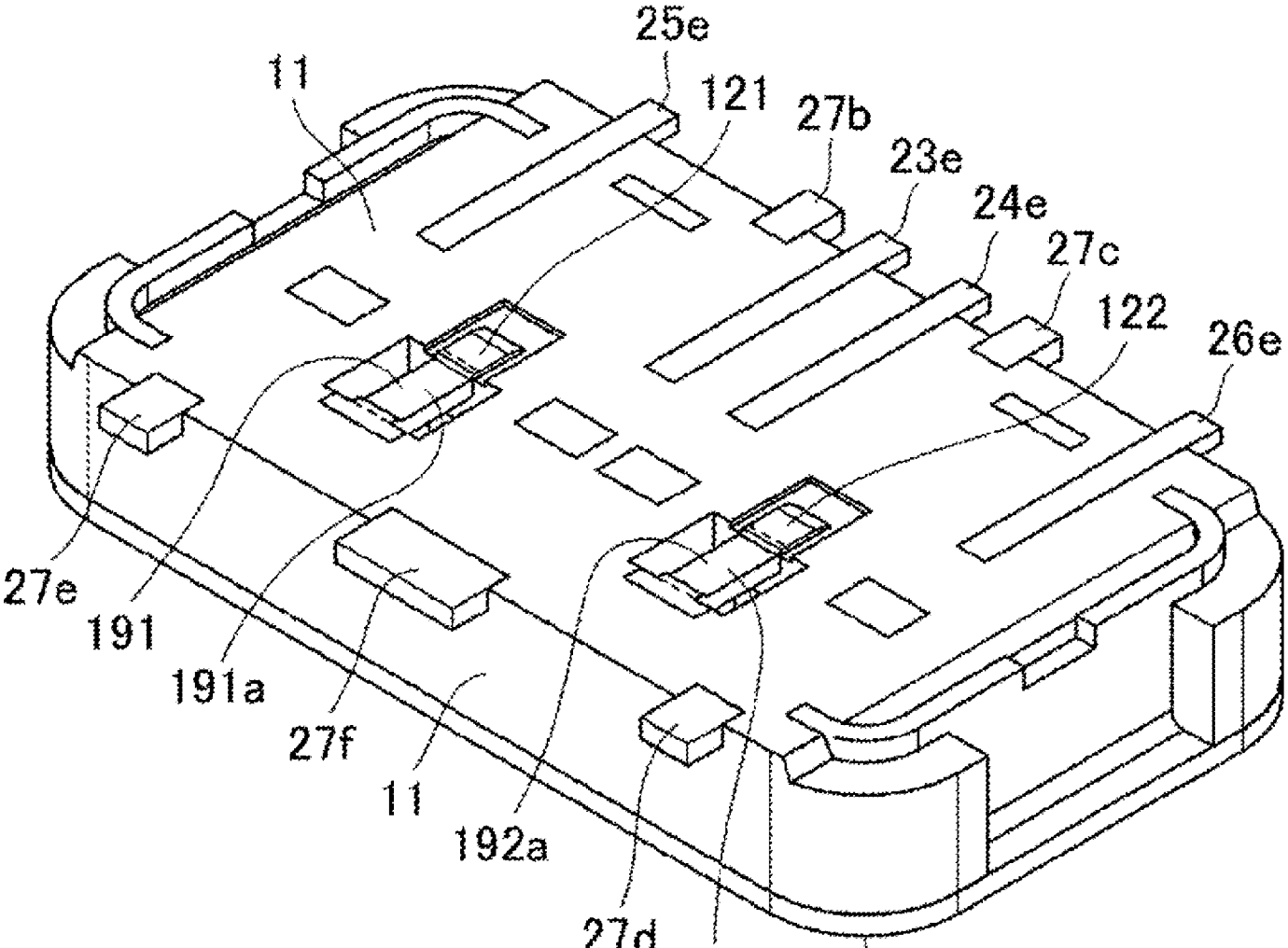
FIG. 17 is a perspective view showing the bottom surface side of the conductor base member being fixed to the housing in the method for manufacturing a plug according to the embodiment of the present invention.
Figure 18A:
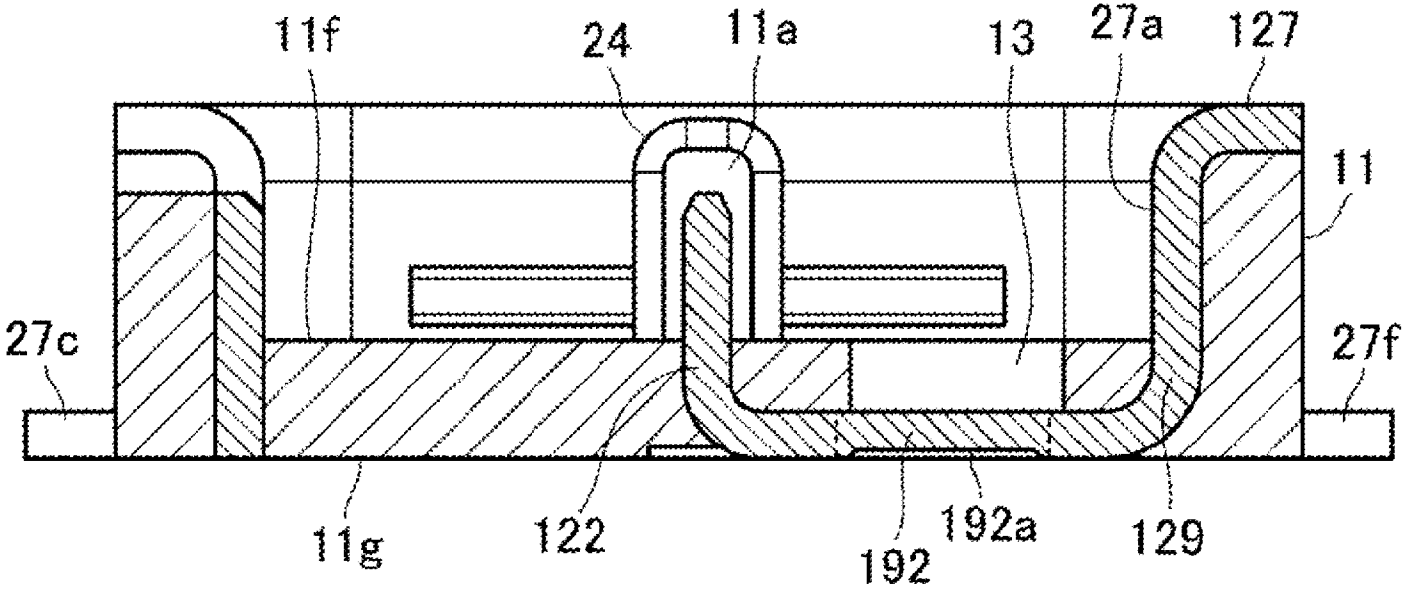
FIG. 18A is a cross-sectional view taken along line XVIIIA-XVIIIA in FIG. 16.
Figure 18B:
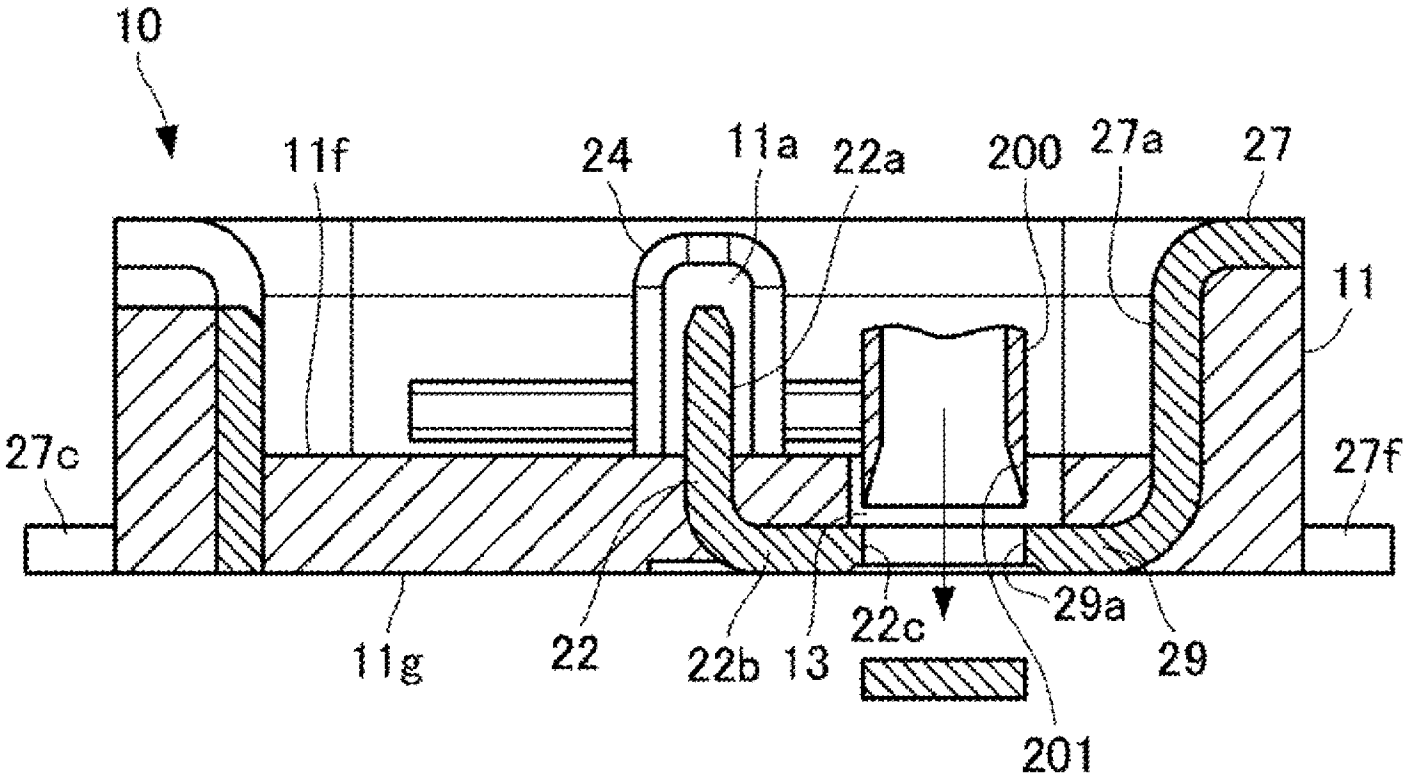
FIG. 18B is a cross-sectional view showing a cross section corresponding to FIG. 18A and showing a state in which the plug is obtained by cutting a connecting portion of the conductor base member by a cutting means.

According to the manufacturing method of the present embodiment, the fabricated conductor base member 100 and the above-described terminals 23 to 26 included in the plug 10 are integrally fixed to the housing 11 as shown in FIGS. 16, 17, and 18A. Subsequently, at least part of the connecting portion 192 is cut by a cutting part 201 of a suitable cutting means (e.g., a cutter jig) 200 as shown in FIG. 18B, and at least part of the connecting portion 191 is similarly cut, thus obtaining the plug 10.

Fixing the conductor base member 100 and the terminals 23 to 26 to the housing 11 can be easily performed by integrating the conductor base member 100 and the terminals 23 to 26 with the housing 11 by means of insert molding of the housing 11. Alternatively, the conductor base member 100 and the terminals 23 to 26 may be fixed to a molded housing 11 by a means such as bonding, press fitting, or a fit, if possible.

The housing 11 is provided, in advance, with the above-described through holes 12 and 13, which pass through the housing 11 from the front surface 11*f* to the bottom surface 11*g*, and these through holes 12 and 13 are configured so that the cutting means 200 can reach the connecting portions 191 and 192 through the through holes 12 and 13.

The cutting means 200 is configured to be able to cut the connecting portions 191 and 192 by the cutting part 201 by action of pressure cutting in a direction from the front surface 11*f* of the housing 11 to the bottom surface 11*g*.

As shown in FIGS. 17 and 18A, the connecting portions 191 and 192 include, at bottom surfaces thereof (surfaces on the same side as the bottom surface 11*g* of the housing 11), recesses 191*a* and 192*a*, respectively, for reducing a thickness of the connecting portions 191 and 192 to be smaller than the thickness of the central terminal portions 121 and 122 and the protruding piece portions 128 and 129 of the grounded conductor portion 127. These recesses 191*a* and 192*a* are formed on the bottom surfaces of the connecting portions 191 and 192, which are surfaces on the side toward which the pressure of the cutting means 200 is applied (the external surfaces on the side toward which the pressure is applied). These recesses 191*a* and 192*a* are formed in the conductor base member 100 prior to fixing the conductor base member 100 to the housing 11 by means of partial squeezing, for example. Note that the part of the grounded conductor portion 127 except for the recesses 191*a* and 192*a* has a uniform thickness.

The cutting of the connecting portions 191 and 192 by the cutting means 200 is performed at places that are at least part of the connecting portions 191 and 192 and located within areas corresponding to the recesses 191*a* and 192*a* (areas between both ends of the recesses 191*a* and 192*a*).

As a result of the above-described process, the plug 10 according to the present embodiment shown in FIGS. 1 to 4 can be obtained. That is, in the plug 10 obtained according to the manufacturing method of the present embodiment, the central terminal portions 121 and 122 are formed as the central terminals 21 and 22, and the grounded conductor portion 127 is formed as the grounded conductor 27 as a result of cutting the connecting portions 191 and 192. Moreover, the protruding piece portions 128 and 129 of the grounded conductor portion 127 are formed as the protruding pieces 28 and 29, respectively. Furthermore, the cutting of the connecting portions 191 and 192 causes the central terminals 21 and 22 to have the central terminal protrusions 21*c* and 22*c*, which protrude into the through holes 12 and 13, respectively, and causes the protruding pieces 28 and 29 to have the grounded conductor protrusions 28*a* and 29*a*, which protrude into the through holes 12 and 13, respectively.

Figure 19:
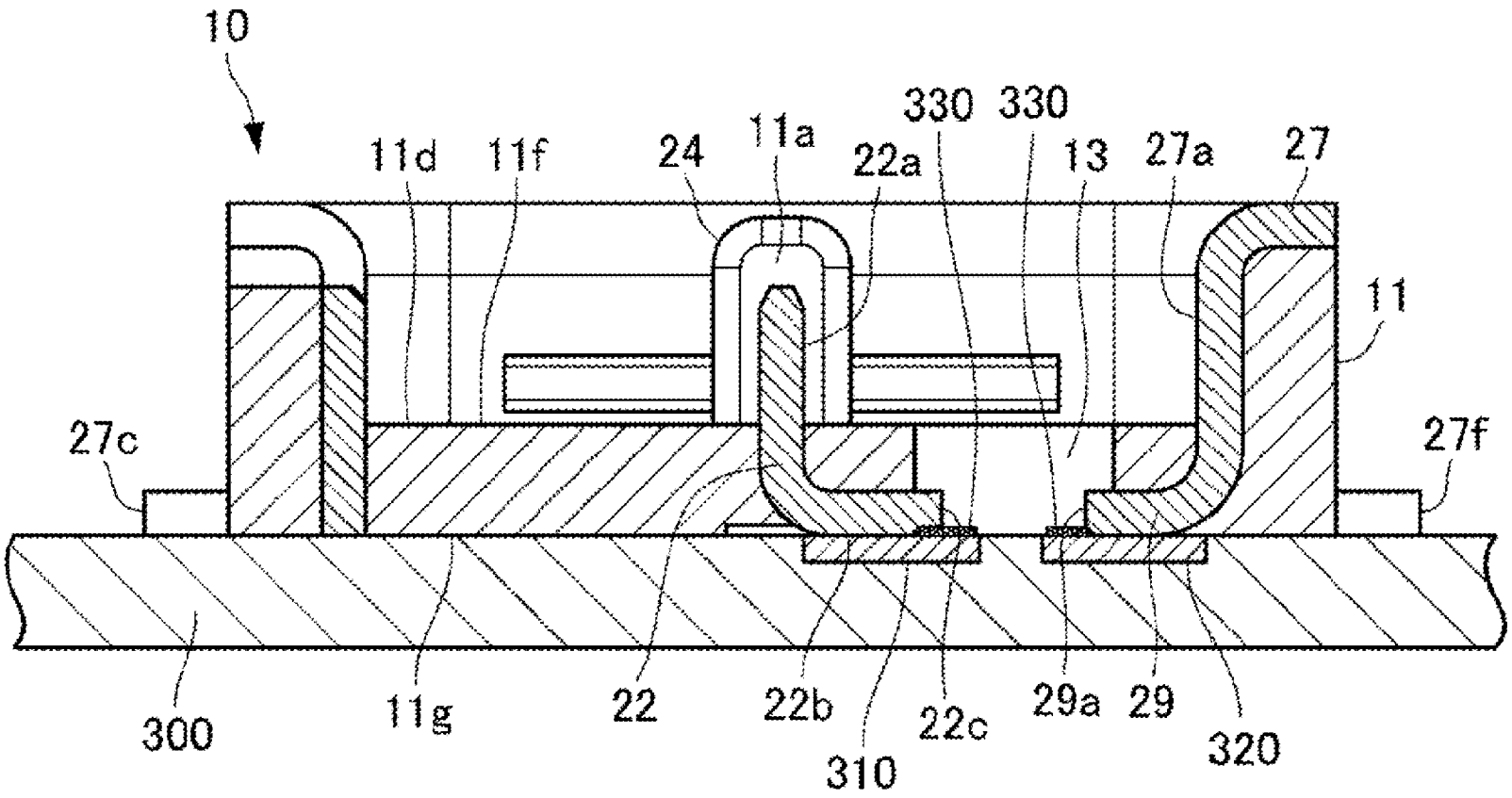
FIG. 19 is a cross-sectional view showing a cross section corresponding to FIG. 18A and showing a state in which a central terminal and a grounded conductor of the plug according to the embodiment of the present invention are connected to electrodes in a substrate.

In the plug 10, the central terminal protrusions 21*c* and 22*c* and the grounded conductor protrusions 28*a* and 29*a* can be connected to electrodes in a substrate on which the plug 10 is mounted by means of soldering. FIG. 19 is a diagram illustrating a state in which the central terminal protrusion 22*c* is connected to a signal electrode 310 in a substrate 300, and the grounded conductor protrusion 29*a* is connected to a grounded electrode 320 in the substrate 300. Soldering in such a case can be conducted by a technique such as heating and melting solder cream 330, which is applied to the signal electrode 310 and the grounded electrode 320, and then cooling and solidifying the molten solder cream 330. Although not shown in the figures, the central terminal protrusion 21*c* and the grounded conductor protrusion 28*a* can be similarly connected to a signal electrode and a grounded electrode in the substrate 300, respectively.

Advantageous effects will next be described.

According to the above-described method for manufacturing the plug 10 according to the present embodiment, the plug 10 having the central terminals 21 and 22 and the grounded conductor 27 separated from each other can be obtained by integrally fixing the conductor base member 100 and the terminals 23 to 26 to the housing 11 and then cutting the connecting portions 191 and 192 of the conductor base member 100. Thus, the plug 10 can be easily manufactured with less time and effort as compared to the conventional techniques. Moreover, since the central terminals 21 and 22 can be omitted as conductor parts at the start of manufacturing the plug 10, the number of conductor parts can be reduced as compared to the conventional techniques. Thus, the manufacturing cost can be reduced.

Moreover, since the central terminals 21 and 22 and the grounded conductor 27, which are obtained after the cutting of the connecting portions 191 and 192, are connected to each other via the connecting portions 191 and 192 before the cutting, relative positions between the central terminals 21 and 22 and the grounded conductor 27 can be set as designed and with high accuracy.

Moreover, in the cutting of the connecting portions 191 and 192 in the conductor base member 100, since only the connecting portions 191 and 192 can be cut through the through holes 12 and 13 without cutting the connecting portions 191 and 192 together with the housing 11, the connecting portions 191 and 192 can be cut easily.

When the connecting portions 191 and 192 are cut by the cutting means 200, burr can be generated along any of the cut edges thereof, i.e., edges of the central terminal protrusions 21*c* and 22*c* and the grounded conductor protrusions 28*a* and 29*a*. Even in such a case, the burr can be confined in the recesses 191*a* and 192*a*, thus preventing the protrusion of the burr. As a result, when the plug 10 is mounted by connecting the central terminal protrusions 21*c* and 22*c* and the grounded conductor protrusions 28*a* and 29*a* to electrodes in a substrate by means of soldering, for example, the plug 10 can be properly mounted without the burr generated in the cutting interfering with the electrodes in the substrate.

Moreover, the plug 10 obtained according to the above-described manufacturing method can effectively reduce signal leakage to the outside by the shielding effects of the shell portion 27*a* of the grounded conductor 27. Similarly, the receptacle 50 according to the present embodiment can effectively reduce signal leakage to the outside by the shielding effects of the shell-shaped conductor 71.

Figure 20A:
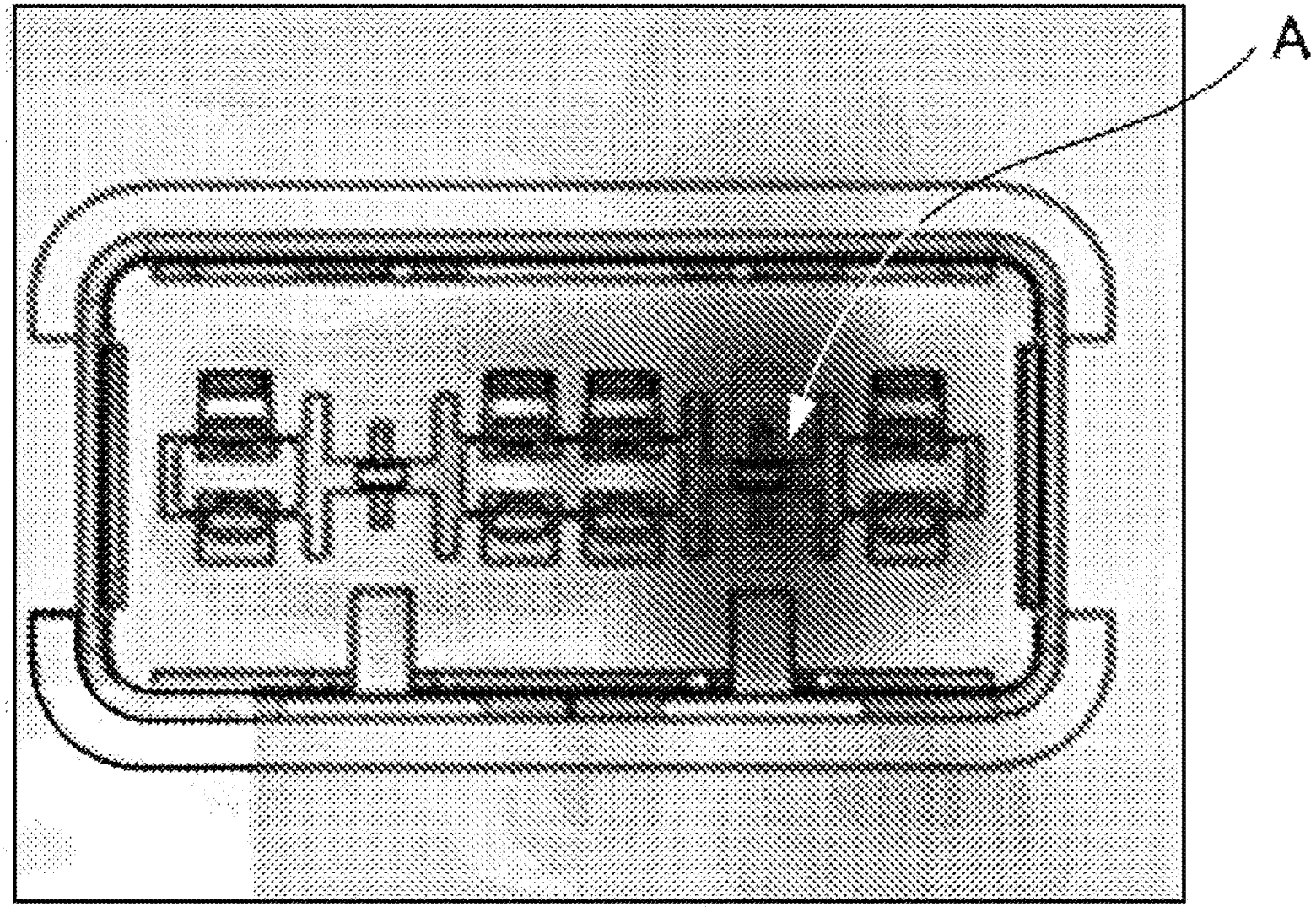
FIG. 20A is a simulation diagram showing calculated signal leakage when the plug and the receptacle according to the present embodiment are connected to each other by a fit therebetween.
Figure 20B:
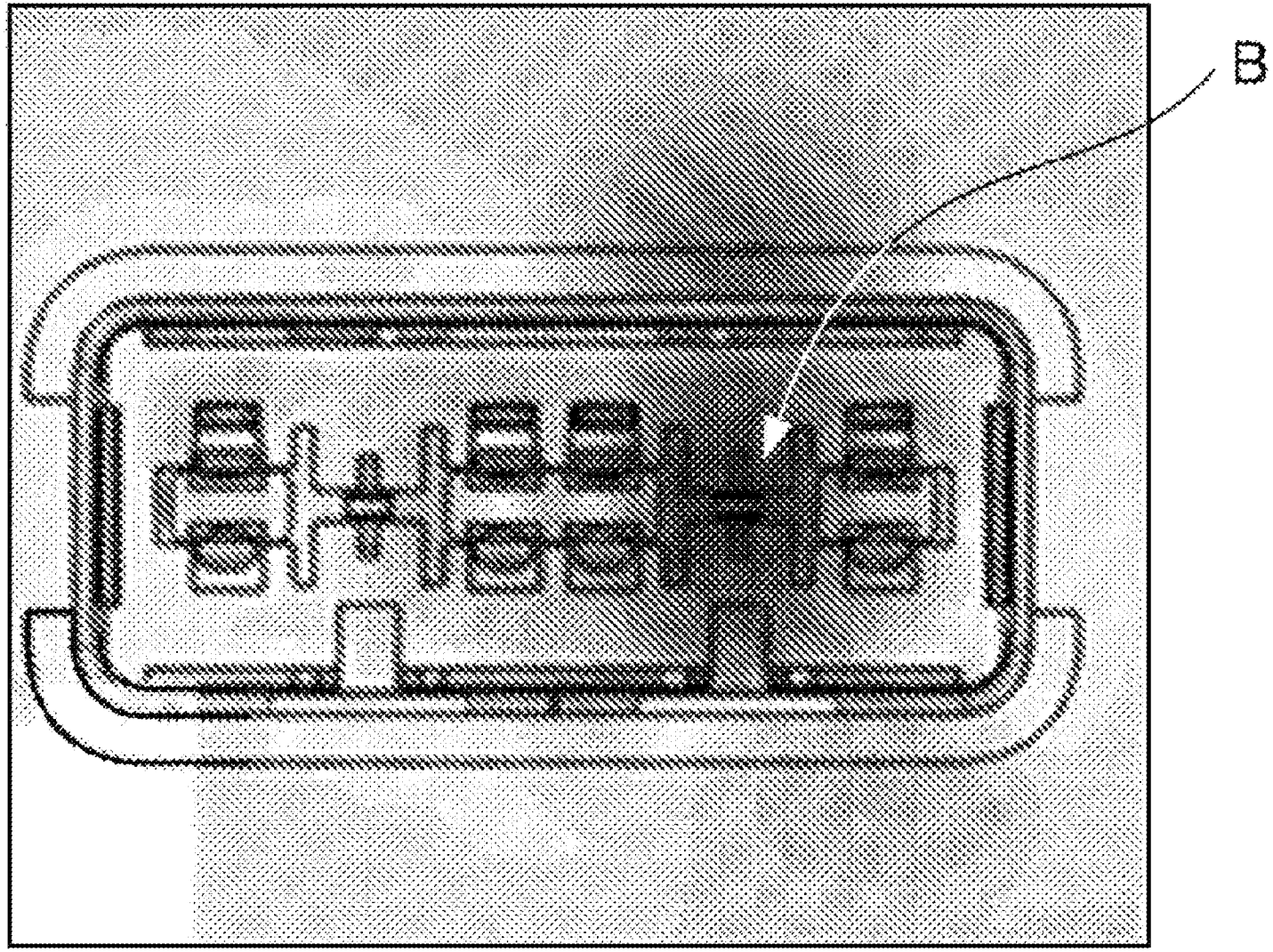
FIG. 20B is a simulation diagram showing calculated signal leakage when a plug and a receptacle according to a comparative example are connected to each other by a fit therebetween.

FIG. 20A is a simulation diagram showing calculated signal leakage when one central terminals 22 and 63 transmit a high-frequency signal of a predetermined frequency (e.g., 10 GHz) in a state (see FIG. 12) where the plug 10 and the receptacle 50 according to the present embodiment are connected to each other by a fit therebetween. FIG. 20B, on the other hand, is a simulation diagram showing calculated signal leakage in a comparative example against the present embodiment.

Figure 21:
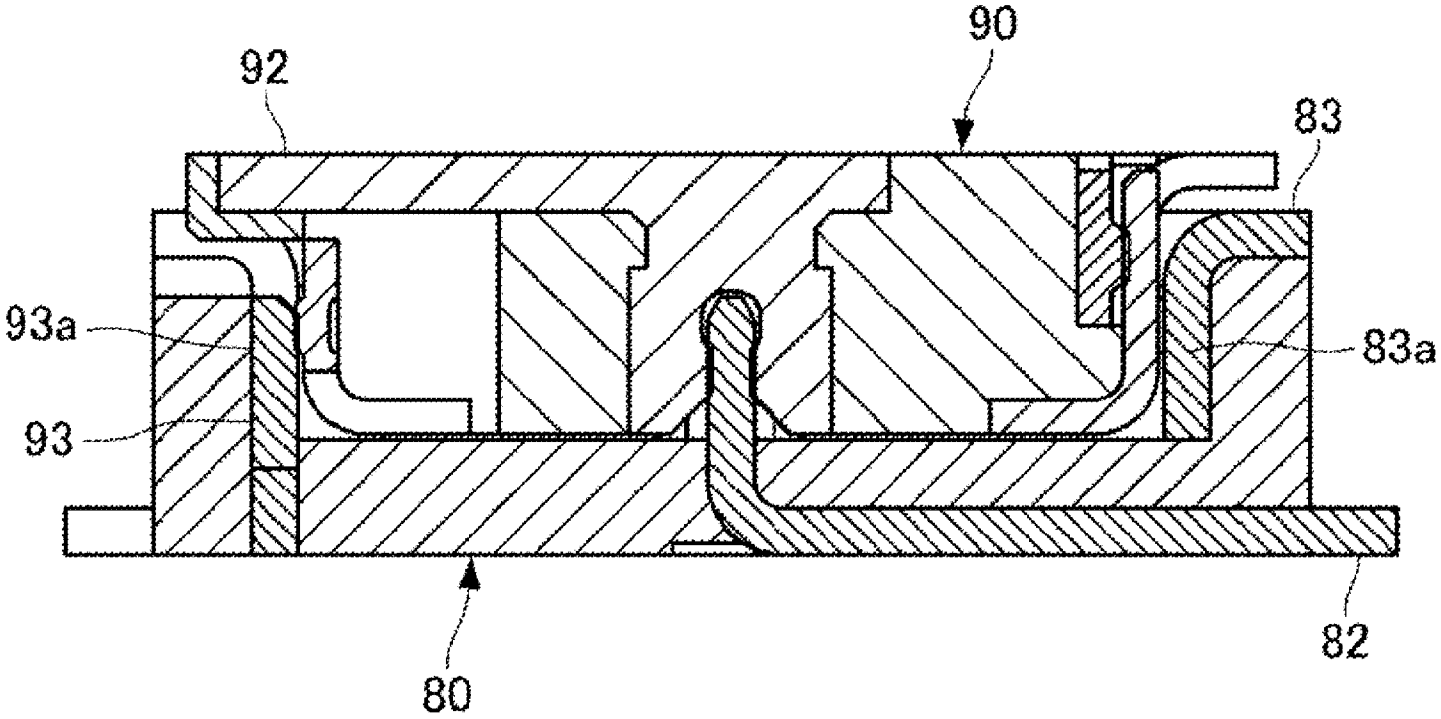
FIG. 21 is a cross-sectional view showing a state in which the plug and the receptacle according to the comparative example are connected to each other by a fit therebetween.

FIG. 21 is a diagram illustrating a plug 80 and a receptacle 90 in the comparative example. A central terminal 82 in the plug 80 passes through a region below a peripheral wall 83*a* of a grounded conductor 83 and extends to the outside. A central terminal 92 in the receptacle 90 extends outwardly past a peripheral wall 93*a* of a grounded conductor 93.

In FIG. 20A, a hazy portion, indicated by black color, around a connected portion A of the central terminals 22 and 62 represents the spread of a signal. In FIG. 20B, a hazy portion, indicated by black color, around a connected portion B of the central terminals 82 and 92 represents the spread of a signal.

In the plug 10 and the receptacle 50 shown in FIG. 20A according to present embodiment, signal leakage to the outside is suppressed. This is attributed to the shielding effects of the shell portion 27*a* of the grounded conductor 27. In the plug 80 and the receptacle 90 shown in FIG. 20B according to the comparative example, on the other hand, signal leakage to the outside is generated due to the outward extension of the central terminals 82 and 92 past the peripheral walls 83*a* and 93*a*.

In the plug 10 obtained according to the above-described manufacturing method, the central terminal protrusion 21*c* and the grounded conductor protrusion 28*a*, which protrude into the through hole 12, are disposed adjacent to each other, and the central terminal protrusion 22*c* and the grounded conductor protrusion 29*a*, which protrude into the through hole 13, are disposed adjacent to each other. Transmission characteristics can be improved by grounding the grounded conductor protrusions 28*a* and 29*a*, which are disposed adjacent to the central terminals 21 and 22 as just described, to the substrate.

Since the plug 10 obtained according to the above-described manufacturing method is mounted by connecting the central terminal protrusions 21*c* and 22*c* and the grounded conductor protrusions 28*a* and 29*a* to electrodes in a substrate, the connection state can be visually checked through the through holes 12 and 13.

The plug 10 can be mounted on a substrate with the grounded conductor protrusions 28*a* and 29*a* being grounded inside of the outer shape of the plug 10. Grounding the grounded conductor protrusions 28*a* and 29*a* in this manner can achieve a reduction in the size (mounting size) of the plug 10 including the mounted portion. In such a case, the connection portions 27*b* to 27*f* of the grounded conductor 27, which protrude outwardly from the housing 11, can be omitted.

Although the two central terminals 21 and 22 for transmitting high-frequency signals are included in the plug 10 of the above-described embodiment, the number of the central terminals is not limited thereto. The present invention can be applied also to a multipole connector including three or more central terminals. Also, the present invention is not limited to a connector of a coaxial or pseudo coaxial structure. The present invention can be applied to connectors in various forms.

The embodiment of the present invention can provide a connector having excellent transmission characteristics, and a method for manufacturing such a connector, by which a connector can be manufactured more easily than in the conventional techniques, and thus its manufacturing cost can be reduced. For example, the embodiment of the present invention is useful in a connector of a coaxial or pseudo coaxial structure, which is suitable for transmitting signals such as high-frequency signals.

REFERENCE SIGNS LIST

10 plug (connector)
11, 51 housing
12, 13 through hole
21, 22 central terminal (signal terminal)
21*c*, 22*c* central terminal protrusion (signal terminal protrusion)
27 grounded conductor
27*a* shell portion
28*a*, 29*a* grounded conductor protrusion
50 receptacle (counterpart connector)
61, 62 central terminal (counterpart signal terminal)
100 conductor base member
121, 122 central terminal portion (signal terminal portion)
127 grounded conductor portion
191, 192 connecting portion
191*a*, 192*a* recess
200 cutting means

The invention claimed is:

1. A method for manufacturing a connector, the connector including: a signal terminal; a grounded conductor having a shell portion arranged over a whole circumference of an area around the signal terminal so as to surround the signal terminal; and an electrically insulating housing that integrally fixes the signal terminal and the grounded conductor so as to be electrically insulated from each other, in which the signal terminal is electrically connected to a counterpart signal terminal by means of a fit between the connector and a counterpart connector, wherein, the housing includes a through hole passing through the housing from a front surface to a bottom surface, the signal terminal includes a signal terminal protrusion that protrudes into the through hole at a leading end of a mounting portion, the mounting portion exposed on the bottom surface; and the grounded conductor includes a grounded conductor protrusion that protrudes into the through hole so as to be adjacent to the signal terminal protrusion, the method comprising:

integrally forming, with an electrically conductive material, a conductor base member including a signal terminal portion to form the signal terminal, a grounded conductor portion to form the grounded conductor, a connecting portion for connecting between the signal terminal portion and the grounded conductor portion so as to integrate the signal terminal portion and the grounded conductor portion together, and the shell portion;

integrally fixing the conductor base member to the housing having the through hole such that the signal terminal protrusion protrudes into the through hole at a leading end of the mounting portion leaving the mounting portion exposed on the bottom surface and the grounded conductor protrusion protrudes into the through hole so as to be adjacent to the signal terminal protrusion; and cutting at least part of the connecting portion by a cutting means to configure the signal terminal portion as the signal terminal and configure the grounded conductor portion as the grounded conductor.

2. The method for manufacturing a connector according to claim 1, wherein the housing is provided with the through hole, capable of exposing the connecting portion and allowing the cutting means to reach the connecting portion, formed in advance through a region from one surface to the other surface of the housing.

3. The method for manufacturing a connector according to claim 2, wherein the connecting portion is cut by action of pressure cutting made by the cutting means, and the connecting portion includes, at a surface on a side toward which the pressure is applied, a recess for reducing a thickness of the connecting portion to be smaller than a thickness of the signal terminal portion and the grounded conductor portion, and cutting is performed within an area corresponding to the recess.

4. A connector comprising:

a signal terminal to be electrically connected to a counterpart signal terminal by a fit between the connector and a counterpart connector;

a grounded conductor having a shell portion arranged over a whole circumference of an area around the signal terminal so as to surround the signal terminal; and an electrically insulating housing that integrally fixes the signal terminal and the grounded conductor so as to be electrically insulated from each other, wherein the housing includes a through hole passing through the housing from a front surface to a bottom surface, the signal terminal includes a signal terminal protrusion that protrudes into the through hole at a leading end of a mounting portion, the mounting portion exposed on the bottom surface, and the grounded conductor includes a grounded conductor protrusion that protrudes into the through hole so as to be adjacent to the signal terminal protrusion.

* * * * *